US011122858B2

(12) United States Patent
Hatano et al.

(10) Patent No.: US 11,122,858 B2
(45) Date of Patent: Sep. 21, 2021

(54) SHOE SOLE

(71) Applicant: ASICS CORPORATION, Hyogo (JP)

(72) Inventors: Genki Hatano, Hyogo (JP); Takashi Inomata, Hyogo (JP); Kenta Moriyasu, Hyogo (JP); Sho Takamasu, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 72 days.

(21) Appl. No.: 16/470,977

(22) PCT Filed: Dec. 8, 2017

(86) PCT No.: PCT/JP2017/044140
§ 371 (c)(1),
(2) Date: Jun. 19, 2019

(87) PCT Pub. No.: WO2018/123509
PCT Pub. Date: Jul. 5, 2018

(65) Prior Publication Data

US 2020/0022452 A1 Jan. 23, 2020

(30) Foreign Application Priority Data

Dec. 27, 2016 (WO) ..... PCT/JP2016/088930

(51) Int. Cl.
*A43B 13/12* (2006.01)
*A43B 13/14* (2006.01)
*A43B 13/18* (2006.01)

(52) U.S. Cl.
CPC ..... *A43B 13/141* (2013.01); *A43B 13/125* (2013.01); *A43B 13/181* (2013.01)

(58) Field of Classification Search
CPC ..... A43B 613/125; A43B 613/127; A43B 613/181; A43B 613/18; A43B 613/141
USPC ..... 36/30 R, 28
See application file for complete search history.

(56) References Cited

U.S. PATENT DOCUMENTS

| | | | |
|---|---|---|---|
| 4,881,329 | A | 11/1989 | Crowley |
| 6,338,206 | B1 | 1/2002 | Kita |
| 8,863,407 | B2 | 10/2014 | Nishiwaki et al. |
| 2014/0182165 | A1 | 7/2014 | Lee |
| 2016/0015122 | A1 | 1/2016 | Nishiwaki et al. |

FOREIGN PATENT DOCUMENTS

| | | |
|---|---|---|
| DE | 102012110573 | 5/2014 |
| JP | H02-114905 | 4/1990 |
| JP | 2001-231605 | 8/2001 |
| JP | 2014-515977 | 7/2014 |
| KR | 10-2010-0045661 | 5/2010 |
| WO | 00/30486 | 6/2000 |
| WO | 2013/145218 | 10/2013 |
| WO | 2014/141467 | 9/2014 |

OTHER PUBLICATIONS

International Search Report Issued in PCT/JP2017/044140 dated Mar. 13, 2018.
"Search Report of Europe Counterpart Application", dated Nov. 22, 2019, p. 1-p. 7.

*Primary Examiner* — Ted Kavanaugh
(74) *Attorney, Agent, or Firm* — JCIPRNET

(57) ABSTRACT

A shoe sole includes an outsole having a contact surface, and a midsole arranged over the outsole, contacting with the outsole. The midsole defines a tunnel-shaped or groove-shaped hollow extending in a front-rear direction of a shoe. At least a part of the hollow is formed in a tunnel shape.

21 Claims, 28 Drawing Sheets

SHOE SOLE

CROSS-REFERENCE TO RELATED APPLICATION

This application is a 371 application of the international PCT application serial no. PCT/JP2017/044140, filed on Dec. 8, 2017, which claims the priority benefit of international PCT application serial no. PCT/JP2016/088930, filed on Dec. 27, 2016. The entirety of each of the above-mentioned patent applications is hereby incorporated by reference herein and made a part of this specification.

TECHNICAL FIELD

The present invention relates to a shoe sole (shoe bottom) with a midsole.

BACKGROUND ART

Providing a groove at the lower surface of a shoe sole for improving reproducibility of a movement locus of a load center (center of pressure) is publicly known (first document listed below).

Forming means of controlling running using a gap at a midsole is also publicly known (second document listed below).

CITATION LIST

Patent Documents

First patent document: U.S. Pat. No. 8,863,407B2 (front page)

Second patent document: PCT/JP2012/58396 (FIGS. 14 and 16)

Third patent document: WO 2013/145218 A1

Fourth patent document: WO 2014/141467 A1

Fifth patent document: JP 2001-231605 A

Sixth patent document: WO 00/30486 A1

Seventh patent document: JP 2014-515977 A

SUMMARY OF INVENTION

However, none of the documents listed above sufficiently states that providing a three-dimensional hollow at a midsole of a shoe sole achieves not only improvement of reproducibility of a movement locus of a load center during running but also improvement of shock absorbency or stability performance.

Thus, the present invention is intended to provide a shoe sole capable of improving reproducibility of the movement locus and capable of improving shock absorbency and stability performance.

The present invention is intended for a shoe sole, wherein:

the shoe sole includes an outsole 4 having a contact surface 4*f*, and a midsole 1 arranged over the outsole 4, contacting with the outsole 4;

the midsole 1 defines a tunnel-shaped or groove-shaped hollow 1T, 1G extending in a front-rear direction of a shoe; and at least a part of the hollow is formed in a tunnel shape.

In the present invention, the midsole means a part not including a hard leather sole. The midsole is generally made of a foamed body or a non-foamed body of resin. For example, the midsole may include gel in addition to a foamed body of EVA or a non-foamed body of polyurethane.

If the shoe sole includes the midsole between an outsole and an insole, a part except the outsole and the insole forms the midsole. In this case, a groove is provided at the midsole for reason that each of the foregoing performances is improved more easily than providing a groove at the outsole which is too hard or at the insole or a sock liner which is too soft.

In the shoe sole made of a foamed body of a substantially equal thickness or a thick and soft structure, an entire thick part forms the midsole and only a contact surface of the thick part forms an outsole.

In the present invention, the hollow means a tunnel-shaped, groove-shaped, or recessed hole or cavity (depression), and includes a structure where the hollow is filled with a material different from and softer than a material of the midsole.

The tunnel-shaped hollow includes a hollow not open toward an upward direction or a downward direction along a cross section of the midsole but surrounded by the midsole at least at a circumference of the hollow. If an insole is arranged on the midsole, forming a groove at the upper surface of the midsole and covering the groove with the insole makes the groove function as the tunnel-shaped hollow. If an outsole as a separate material is arranged below the midsole, forming a groove or a recess at the lower surface of the midsole and covering such a groove with the outsole makes such a groove function as the tunnel-shaped hollow.

The groove-shaped hollow means an elongated hollow open (not covered) toward a downward direction (toward a road surface) along a cross section of the shoe sole.

The recessed hollow means a cavity like a depression.

The hollow may be formed by connecting two or more tunnels, grooves, or recesses.

The front-rear direction means a lengthwise direction. A direction toward the toe of a shoe is a front direction, and a direction toward the heel of the shoe is a rear direction.

Extension in the front-rear direction covers extension in a diagonal direction more approximate to the front-rear direction than a cross sectional direction orthogonal to the front-rear direction.

Principle of Invention

The principle of the present invention will be described next.

FIG. 11 shows a dynamic model of a cross section of a midsole 1.

FIG. 11(*a*) shows a model of the midsole 1 with a tunnel-shaped hollow. FIG. 11(*b*) shows a model of the midsole 1 with a groove-shaped hollow.

As shown in FIGS. 11(*a*) and (*b*), if uniformly distributed load is applied to the upper surfaces of the models of the midsole, the models are deformed, as shown in FIGS. 11(*c*) and (*d*). As understood from these drawings, a tunnel-shaped hollow 1T causes larger deformation in the model than a groove-shaped hollow 1G.

The present inventors conducted a simulation using a computer and have found that the foregoing deformation resulting from the foregoing load becomes greater with a closer distance of the tunnel-shaped hollow 1T to an upper surface F1 of the midsole 1.

The foregoing deformation will achieve not only the foregoing shock absorbency but also stability performance and reproducibility during running. Thus, devising the arrangement and the shape of a hollow is expected to improve each of the foregoing performances.

The foregoing deformation will produce not only effect on the position of a center of pressure (CoP) as a load center during running but also effect on a movement speed Vc of the center of pressure CoP. Thus, change in the position of the foregoing hollow in a height direction will affect the movement speed Vc. Thus, devising the position of the hollow in the height direction is expected to control the movement speed Vc.

BRIEF DESCRIPTION OF DRAWINGS

In FIGS. 5 to 7, a through hole at a lower part of the midsole is given dots.

DESCRIPTION OF EMBODIMENTS

Figure 1:
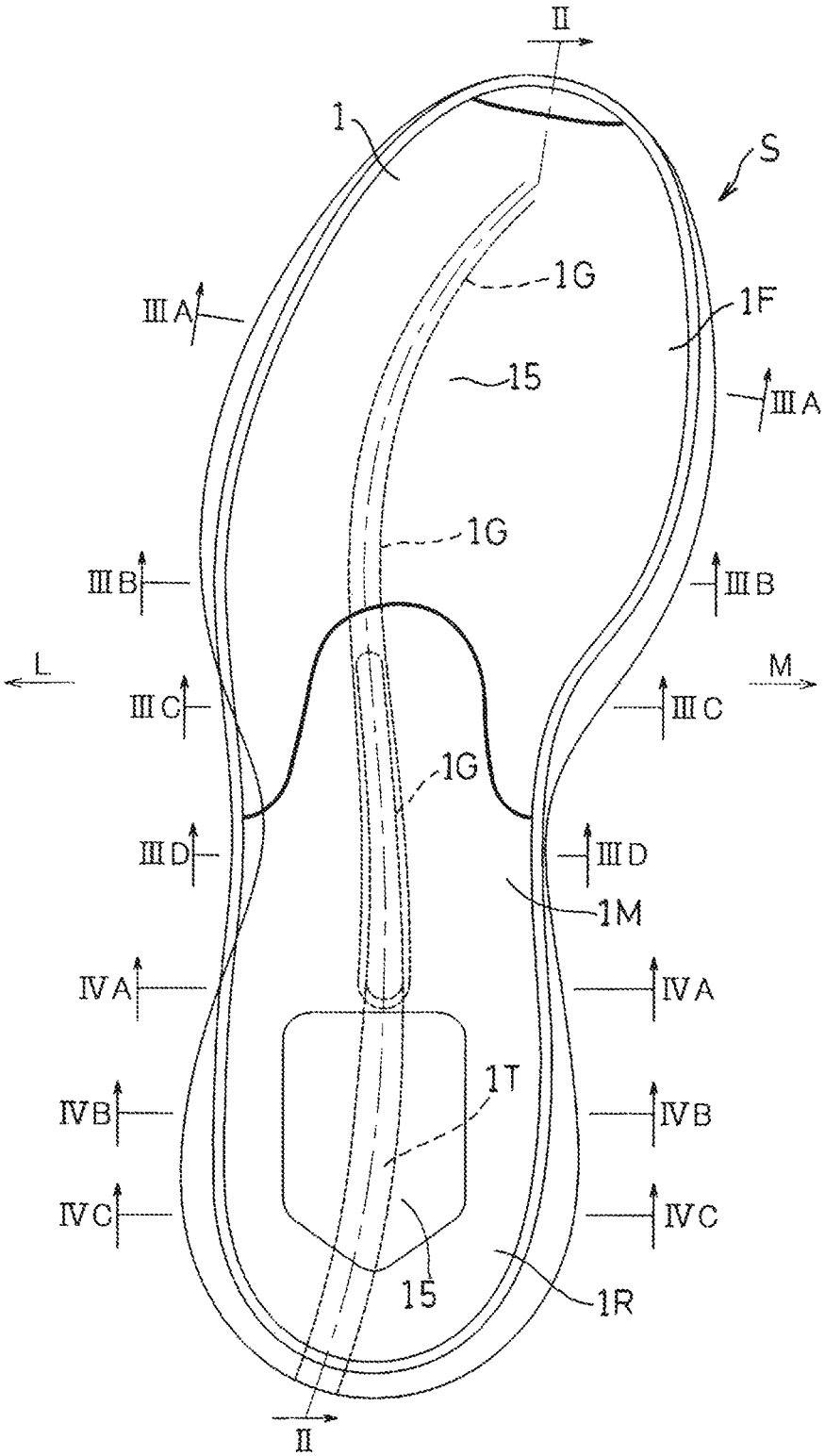
FIG. 1 is a plan view of a midsole showing a first embodiment of the present invention.

Preferably, in the shoe sole, the tunnel-shaped hollow 1T is provided in a rearfoot portion 1R of the midsole 1 so as to extend in the front-rear direction, and the tunnel-shaped hollow 1T in the rearfoot portion 1R is open toward a front direction or a rear direction.

In this case, the tunnel-shaped hollow 1T in the rearfoot portion 1R is open toward the front direction or the rear direction. This prevents unintentional resistance or resilience in the tunnel-shaped hollow 1T to be caused by air pressure.

More preferably, in the shoe sole, the tunnel-shaped hollow 1T in the rearfoot portion 1R is open toward the front direction and closed toward the rear direction.

In this case, an opening is absent on a posterior end side of the midsole. This makes it possible to absorb large $1^{st}$ strike at the midsole to be applied to the posterior end side.

"Being open toward the front direction" mentioned herein covers a case where the anterior end of the tunnel-shaped hollow 1T in the rearfoot portion 1R is open toward the tunnel-shaped hollow or a groove in a middle foot portion. In this case, a hollow or a groove in the middle foot portion may be open toward a medial side and/or a lateral side.

Preferably, in the shoe sole, the tunnel-shaped hollow 1T is provided in the rearfoot portion 1R of the shoe sole;

a middle foot portion 1M is provided with a tunnel-shaped through hole 1H extending in a cross sectional direction and penetrating the middle foot portion 1M in the cross sectional direction; and the tunnel-shaped hollow 1T is open toward the tunnel-shaped through hole 1H.

In this case, the through hole 1H is expected to achieve the flexibility or lightweight properties of the midsole 1 in the middle foot portion 1M.

Preferably, in the shoe sole, the midsole 1 includes the rearfoot portion 1R, the middle foot portion 1M, and a forefoot portion 1F;

the tunnel-shaped or groove-shaped hollow is provided so as to extend across the rearfoot portion 1R, the middle foot portion 1M, and the forefoot portion 1F;

at least in the rearfoot portion 1R, the tunnel-shaped hollow 1T forms a tunnel portion 1T where the midsole 1 surrounds a circumference of a cross section of the tunnel-shaped hollow;

at least in the forefoot portion 1F, the groove-shaped hollow 1G is composed of a first groove 100 formed on (at) a lower surface F2 of the midsole 1; and an anterior end of the tunnel portion 1T is continuous with a posterior end of the first groove 100 via the tunnel-shaped or groove-shaped hollow of the middle foot portion 1M.

In this case, the first groove 100 may be covered by the outsole 4, or may not be covered and be open toward a downward direction.

Generally, the midsole is thick in the rearfoot portion and thin in the forefoot portion. This will facilitate formation of the tunnel portion in the rearfoot portion.

The hollow provided so as to extend from the rearfoot portion to the forefoot portion is expected to achieve each of the foregoing performances easily.

Preferably, in the shoe sole, the midsole 1 includes the rearfoot portion 1R, the middle foot portion 1M, and the forefoot portion 1F;

the tunnel-shaped or groove-shaped hollow is provided so as to extend across the rearfoot portion 1R, the middle foot portion 1M, and the forefoot portion 1F;

at least in the rearfoot portion 1R, the tunnel-shaped hollow 1T forms the tunnel portion 1T where the midsole 1 surrounds a circumference of a cross section of the tunnel-shaped hollow;

at least in the forefoot portion 1F, the groove-shaped hollow 1G forms a groove portion 1G where the groove-shaped hollow is open toward a downward direction; and an anterior end of the tunnel portion 1T is continuous with a posterior end of the groove portion 1G via the tunnel-shaped or groove-shaped hollow of the middle foot portion 1M.

Generally, the midsole is thick in the rearfoot portion and thin in the forefoot portion. This will facilitate formation of the tunnel portion in the rearfoot portion. The hollow provided from the rearfoot portion to the forefoot portion is expected to achieve each of the foregoing performances easily.

Preferably, in the shoe sole, the shoe sole includes the rearfoot portion 1R, the middle foot portion 1M, and the forefoot portion 1F;

the midsole 1 is arranged in the rearfoot portion 1R, the middle foot portion 1M, and the forefoot portion 1F;

the outsole 4 is arranged at least in the rearfoot portion 1R and the forefoot portion 1F;

the tunnel-shaped hollow 1T is provided in the rearfoot portion 1R and the forefoot portion 1F;

at least in the rearfoot portion 1R, the tunnel-shaped hollow 1T forms the tunnel portion 1T where the midsole 1 surrounds a circumference of a cross section of the tunnel-shaped hollow;

at least in the forefoot portion 1F, the tunnel-shaped hollow 1T is formed between the lower surface F2 of the midsole 1 and an upper surface 49 of the outsole 4; and an anterior end of the tunnel portion 1T of the rearfoot portion 1R is continuous with a posterior end of the tunnel-shaped hollow 1T of the forefoot portion 1F via the tunnel-shaped or groove-shaped hollow of the middle foot portion 1M.

Generally, the midsole is thick in the rearfoot portion and thin in the forefoot portion. This will facilitate formation of the tunnel portion in the rearfoot portion.

The hollow provided from the rearfoot portion to the forefoot portion is expected to achieve each of the foregoing performances easily.

Preferably, in the shoe sole, the midsole 1 is made of a softer material than the outsole 4;

the midsole 1 includes the rearfoot portion 1R, the middle foot portion 1M, and the forefoot portion 1F;

the tunnel-shaped or groove-shaped hollow 1T, 1G has a downward inclination toward the front direction in a range from 20 to 40% of an entire length of the shoe sole from a posterior end Se of the shoe sole; and in the range from 20 to 40%, the tunnel-shaped hollow 1T is arranged on the rear side, the groove-shaped hollow 1G is arranged on the front side, and a posterior end of the groove-shaped hollow 1G is continuous with an anterior end of the tunnel-shaped hollow 1T.

In a posterior portion of the range from 20 to 40%, the midsole is generally thick to facilitate formation of the tunnel-shaped hollow. In an anterior portion of the range from 20 to 40%, an arch is formed in the midsole in many cases and this structure facilitates formation of the groove-shaped hollow.

As a result of the presence of the downward inclination further at the hollow in the range from 20 to 40%, the movement speed Vc of the center of pressure CoP in the range from 20 to 40% will be controlled easily.

More preferably, in the shoe sole, the tunnel-shaped or groove-shaped hollow is provided in a range from 30 to 40% of the entire length of the shoe sole from the posterior end Se of the shoe sole; and in the range from 30 to 40%, the tunnel-shaped or groove-shaped hollow has a downward inclination toward the front direction X1.

In this case, the movement speed Vc of the center of pressure CoP is reduced along the downward inclination in the range from 30 to 40%, and this will allow reduction in load on a knee joint, as will be described in detail later.

The presence of the downward inclination toward the front direction mentioned herein means that the tunnel-shaped or groove-shaped hollow has a top surface with a downward inclination toward the front direction.

Preferably, in the shoe sole, the midsole 1 is made of a softer material than the outsole 4;

the midsole 1 includes an upper portion 11 and a lower portion 12 vertically joined to each other at least in the rearfoot portion 1R; and the tunnel-shaped hollow 1T extending in the front-rear direction is provided between a lower surface 11*f* of the upper portion 11 and an upper surface 12*f* of the lower portion 12, and the tunnel-shaped hollow 1T has a closed posterior end and an open anterior end.

In this case, the tunnel portion 1T can be formed easily between the vertically divided upper portion and lower portion of the midsole.

Meanwhile, closing the posterior end of the tunnel-shaped hollow 1T improves the performance of absorbing the impact of $1^{st}$ strike to be applied to a posterior end portion of the midsole.

Preferably, at least along one cross section of the tunnel-shaped hollow 1T;

the tunnel-shaped hollow 1T includes a medial half Mh on a medial side and a lateral half Lh on a lateral side; and a centroid Gm of the medial half Mh is arranged below a centroid Gl of the lateral half Lh.

In this case, stability performance will be improved, as will be described in detail later.

Preferably, the midsole 1 includes the rearfoot portion 1R and the tunnel-shaped hollow 1T is provided in the rearfoot portion 1R; and at least along one cross section of the rearfoot portion 1R of the midsole 1, the tunnel-shaped hollow includes the medial half Mh on the medial side and the lateral half Lh on the lateral side, and the centroid Gm of the medial half Mh is arranged below a centroid Gl of the lateral half Lh.

In this case, stability performance will be improved in the rearfoot portion, as will be described in detail later.

Preferably, the first groove 100 formed on (at) the lower surface of the midsole 1 and the second groove 200 formed on (at) the upper surface of the outsole 4 are vertically continuous with each other to form the tunnel-shaped hollow 1T between the upper surface 49 of the outsole 4 and the lower surface F2 of the midsole 1; and with the width of the tunnel-shaped hollow 1T in a cross sectional direction divided uniformly into two, into a medial side and a lateral side at least along one cross section of the hollow 1T, the second groove of the outsole 4 has a larger area in a portion L1 on the lateral side than in a portion M1 on the medial side, thereby offsetting the portion L1 of the tunnel-shaped hollow 1T on the lateral side downward, compared to the portion M1 on the medial side.

In this case, stability performance will be improved, as will be described in detail later.

More preferably, the midsole 1 and the outsole 4 include the rearfoot portion 1R, and the tunnel-shaped hollow 1T is provided in the rearfoot portion 1R; and with the shoe sole divided uniformly into two, into the medial side and the lateral side at least along one cross section of the rearfoot portion 1R, the tunnel-shaped hollow 1T on the lateral side has a larger area than the tunnel-shaped hollow 1T on the medial side.

In this case, the medial side is less likely to be deformed than the lateral side. This will improve stability performance to contribute to suppression of pronation.

Preferably, the midsole 1 is made of a softer material than the outsole 4;

the tunnel-shaped hollow 1T is formed on (at) the lower surface F2 of the midsole 1, and the tunnel-shaped hollow 1T is covered by the outsole 4 and defined by the lower surface F2 of the midsole 1 and the upper surface 49 of the outsole 4;

the tunnel-shaped hollow 1T extends in the front-rear direction; and the tunnel-shaped hollow 1T has a posterior end closed by the midsole 1.

In this case, the outsole is arranged in a portion to become a center of pressure. This may increase traction and propulsion force.

Further, the posterior end of the tunnel-shaped hollow 1T is closed by the midsole 1. This will make it possible to absorb the impact of 1st strike at the midsole 1 to be applied to the posterior end of the midsole 1.

Preferably, the midsole 1 includes the rearfoot portion 1R and the tunnel-shaped hollow 1T is provided in the rearfoot portion 1R; and at least along one cross section of the rearfoot portion 1R of the midsole 1, a centroid G of the tunnel-shaped hollow is arranged closer to the upper surface F1 of the midsole 1 than the lower surface F2 of the midsole 1.

In this case, the midsole is subjected to large deformation such as compressive deformation in the rearfoot portion so high shock absorbency is expected, as will be described in detail later.

The centroid mentioned herein means a center of a graphic and corresponds to an average position among all points in a target graphic.

The cross section means a section along a plane substantially orthogonal to the front-rear direction.

The upper surface of the midsole means a surface to contact a foot. The lower surface of the midsole means a surface to contact a ground.

More preferably, a center line 1C of the tunnel-shaped hollow 1T extending in the front-rear direction is arranged in an upper half H1 of the rearfoot portion 1R in a region more than half of the rearfoot portion 1R in the front-rear direction.

In this case, still higher shock absorbency is expected.

The center line mentioned herein means a line formed by connecting the foregoing centroids in the front-rear direction.

Preferably, the midsole 1 includes the rearfoot portion 1R and the tunnel-shaped hollow 1T is provided in the rearfoot portion 1R; and at least along a part of a longitudinal section of the rearfoot portion 1R, an uppermost end 19 of the tunnel-shaped hollow is arranged in the upper half H1 of the rearfoot portion 1R.

In this case, the midsole is also subjected to large deformation such as compressive deformation in the rearfoot portion and high shock absorbency is also expected.

More preferably, the center line 1C of the tunnel-shaped hollow 1T extending in the front-rear direction is arranged in the upper half H1 of the rearfoot portion 1R in a region more than half of the rearfoot portion 1R in the front-rear direction.

In this case, still higher shock absorbency is expected.

Preferably, the tunnel-shaped or groove-shaped hollow is provided in a range from 0 to 10% of the entire length of the shoe sole from the posterior end Se of the shoe sole; and in the range from 0 to 10%, the tunnel-shaped or groove-shaped hollow has an upward inclination toward the front direction X1.

In this case, the movement speed Vc of the center of pressure CoP is increased along the upward inclination in the range from 0 to 10% to cause the center of pressure CoP to start moving toward the front direction smoothly after landing.

Preferably, the midsole 1 includes the forefoot portion 1F and the tunnel-shaped or groove-shaped hollow is further provided in the forefoot portion 1F.

A movement locus of the center of pressure CoP will be guided in the forefoot portion along the hollow in the forefoot portion. This will improve reproducibility during running further.

Preferably, the tunnel-shaped or groove-shaped hollow is provided in a range from 40 to 50% of the entire length of the shoe sole from the posterior end Se of the shoe sole; and at least along one cross section of the midsole 1 in the range from 40 to 50%, the centroid G of the hollow is arranged at a position closer to the lower surface F2 of the midsole 1 than the upper surface F1 of the midsole 1.

This will provide a downward inclination easily to the hollow in the range from 30 to 40% immediately posterior to the range from 40 to 50%. By doing so, the center of gravity (or the center of pressure) will be moved smoothly.

Still preferably, the tunnel-shaped or groove-shaped hollow is provided in a range from 50 to 80% of the entire length of the shoe sole from the posterior end of the shoe sole; and at least a part of the hollow in the range from 50 to 80% is arranged closer to the lower surface F2 of the midsole 1 than at least a part of the hollow in the range from 40 to 50%.

This case is expected to achieve the effect of reducing the movement speed Vc of the center of pressure CoP in the range from 50 to 80%, as will be described in detail later. In this case, movement speed Vc of the center of pressure CoP is reduced along the downward inclination in the range from 50 to 80%, and this will allow reduction in load on an ankle joint.

Preferably, the hollow is provided in a range from 50 to 80% of the entire length of the shoe sole from the posterior end of the shoe sole; and at least a part of the hollow in the range from 50 to 80% is arranged closer to the upper surface F1 of the midsole 1 than at least a part of the hollow in the range from 40 to 50%.

This case is expected to achieve the effect of increasing the movement speed Vc of the center of pressure CoP in the range from 50 to 80%, as will be described in detail later. In this case, the movement speed Vc of the center of pressure CoP is increased along the upward inclination in the range from 50 to 80%, and this will allow reduction in load on a knee joint.

Preferably, the midsole 1 includes the rearfoot portion 1R, the middle foot portion 1M, and the forefoot portion 1F;

the tunnel-shaped or groove-shaped hollow extends from the rearfoot portion 1R to the forefoot portion 1F; and as the hollow reaches the forefoot portion 1F from the rearfoot portion 1R, the hollow follows a downward inclination toward the front direction X1.

This case is expected to achieve the effect of reducing the movement speed Vc of the center of pressure CoP along the downward inclination.

Preferably, the tunnel-shaped or groove-shaped hollow extends from the rearfoot portion 1R to a position of at least 80% of the entire length of the shoe sole.

In this case, the hollow is expected to achieve an effect in a range from the rearfoot portion to the forefoot portion.

Preferably, the shoe sole includes:

the outsole 4 having a contact surface 4*f*; and the midsole 1 forming the midsole 1 and arranged over the outsole 4.

The midsole 1 is made of a softer material than the outsole 4;

the midsole 1 includes the rearfoot portion 1R, the middle foot portion 1M, and the forefoot portion 1F;

the tunnel-shaped hollow 1T is provided in a range from 10 to 30% of the entire length of the shoe sole from the posterior end Se of the shoe sole; and the tunnel-shaped or groove-shaped hollow 1T, 1G has a downward inclination toward the front direction in a range from 30 to 40% of the entire length of the shoe sole from the posterior end Se of the shoe sole.

Generally, the midsole is thick in the range from 10 to 30% to facilitate formation of the tunnel-shaped hollow.

The downward inclination is further provided at the hollow existing in the range from 30 to 40%. This will facilitate control of the movement speed Vc of the center of pressure CoP in the range from 10 to 40%.

Preferably, the shoe sole includes the outsole 4 having a contact surface; and the midsole 1 forming the midsole 1 and arranged over the outsole 4.

The midsole 1 is made of a softer material than the outsole 4; and the midsole 1 is made of a harder material than an insole and a sock liner arranged over the midsole 1.

The foregoing midsole will fulfill performance as a midsole easily.

The hardness of the midsole is generally set from about 40 to about 75 degrees in terms of Asker C hardness, for example. Even if a material for the midsole has high hardness, giving a flexible structure to the midsole still fulfils a function corresponding to such hardness. Meanwhile, the hardness of an outsole is generally set from about 55 to about 70 degrees in terms of JIS A hardness. The hardness of 70 degrees in terms of this A hardness corresponds to about 86 degrees in terms of the foregoing C hardness.

An insole or a sock liner is generally softer than the midsole and is set at lower harness in terms of Asker C hardness than the midsole by a range from about 5 to about 30 degrees.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

EMBODIMENTS

Embodiments of the present invention will be described below by referring to the drawings.

FIGS. 1 to 7 show a first embodiment.

Figure 2:
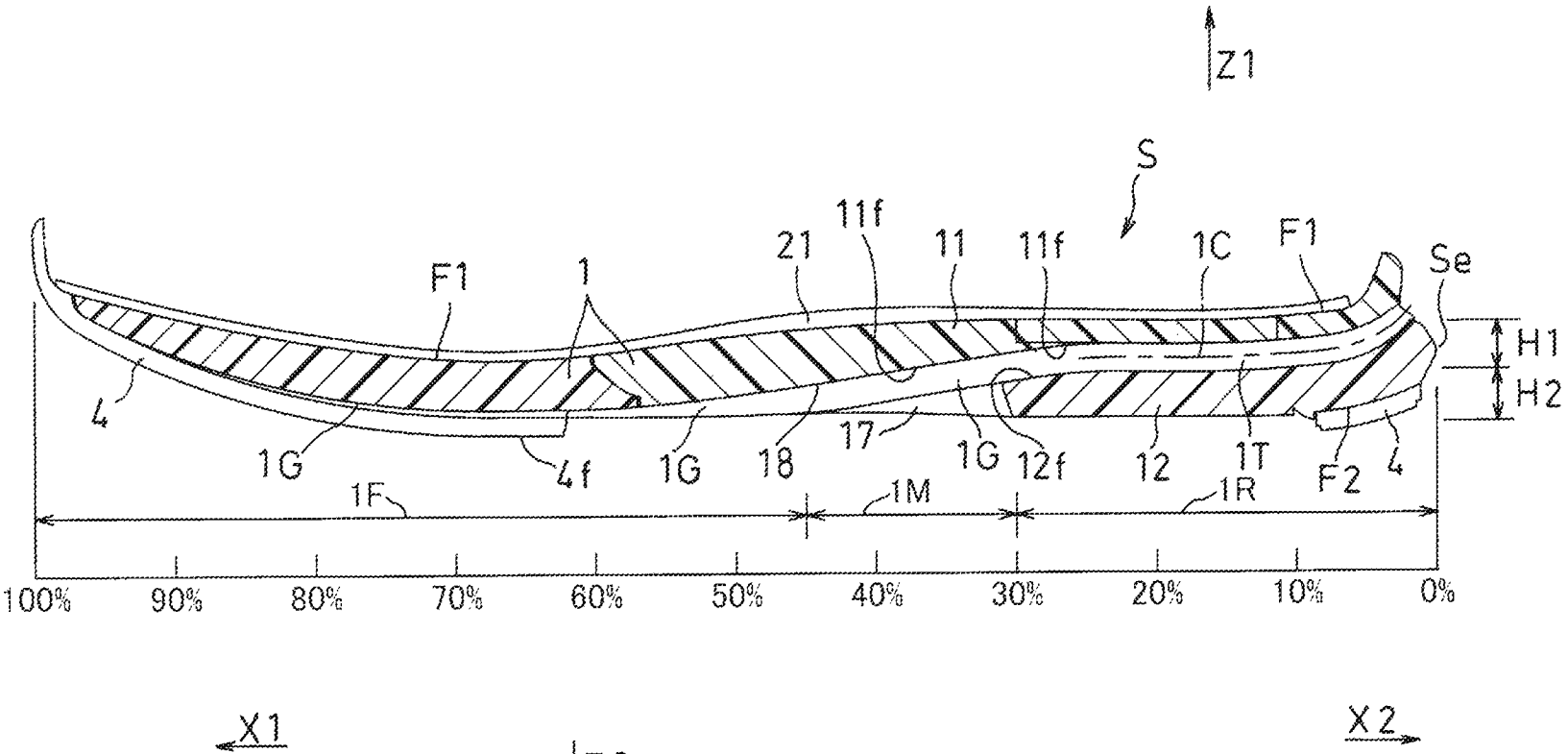
FIG. 2 is a sectional view taken along a line II-II in FIG. 1.

As shown in FIG. 2, a shoe sole S includes an outsole 4 and a midsole 1.

The midsole 1 is made of a material containing a thermoplastic resin component such a foamed body of EVA. Namely, the midsole 1 is made of a material generally called a midsole material.

Figure 8A:
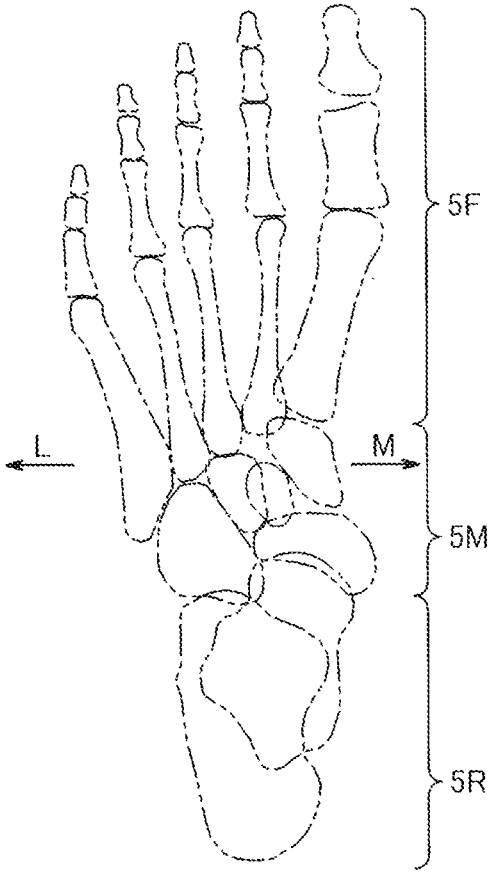
FIGS. 8A and 8B are a plan view and a side view respectively showing a foot skeleton.
Figure 8B:
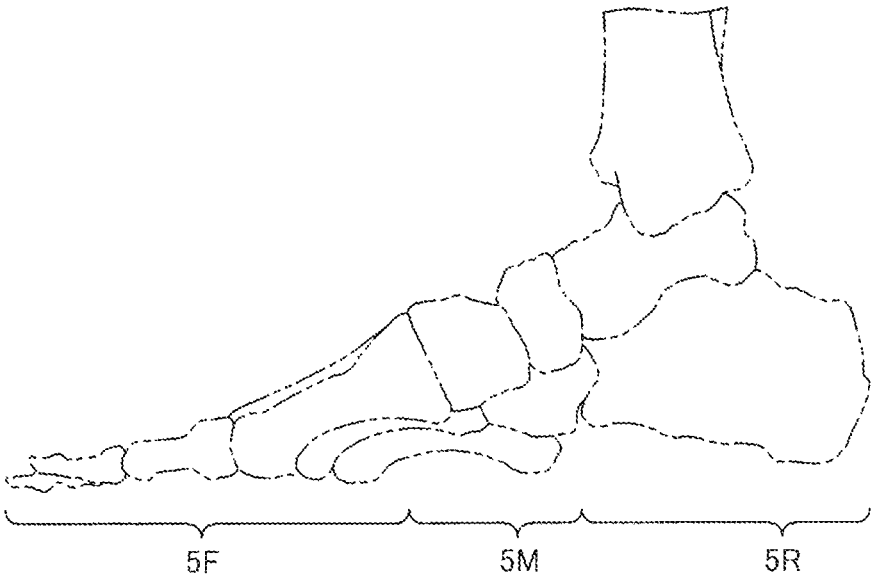

The midsole 1 and the outsole 4 include a forefoot portion 1F, a middle foot portion 1M, and a rearfoot portion 1R shown in FIG. 2 to be fitted with a forefoot section 5F, a middle foot section 5M, and a rearfoot section 5R of a foot respectively shown in FIGS. 8A and 8B to support the sole of the foot entirely.

In FIGS. 8A and 8B, the forefoot section 5F includes five metatarsal bones and 14 phalanges. The middle foot section 5M includes a navicular bone, a cuboid bone, and three cuneiform bones. The rearfoot section 5R includes a talus and a calcaneal bone.

In FIG. 2, the rearfoot portion 1R corresponds to an approximate range from 0 to about 30% of an entire length of the shoe sole S from a posterior end Se of the shoe sole S, for example. The middle foot portion 1M corresponds to a range from about 30 to about 45% of the entire length, for example. The forefoot portion 1F corresponds to a range from about 45 to 100% of the entire length, for example. These ranges are changed by the respective structures of shoes, etc.

The outsole 4 of FIG. 2 may be made of a foamed body or a non-foamed body of rubber, or a non-foamed body or a foamed body of resin such as polyurethane, for example. The outsole 4 has a contact surface 4*f*. The contact surface 4*f* mentioned herein means a surface to contact a flat road surface at least in a non-load position or a standstill position.

Figure 4A:
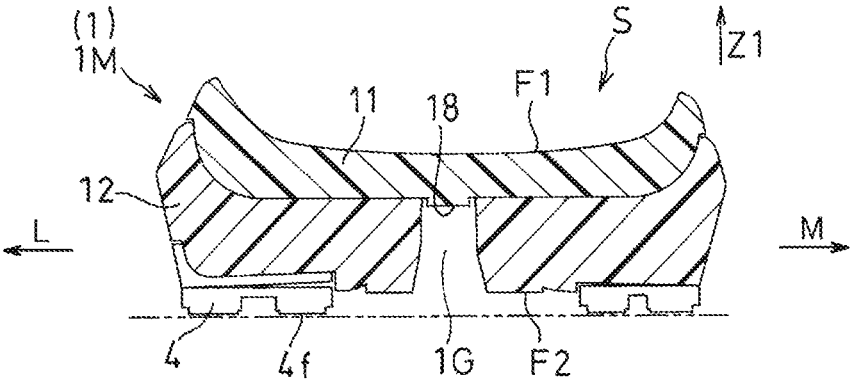
FIGS. 4A, 4B, and 4C are cross sectional views taken along a line IVA-IVA, a line IVB-IVB, and a line IVC-IVC in FIG. 1 respectively.
Figure 4B:
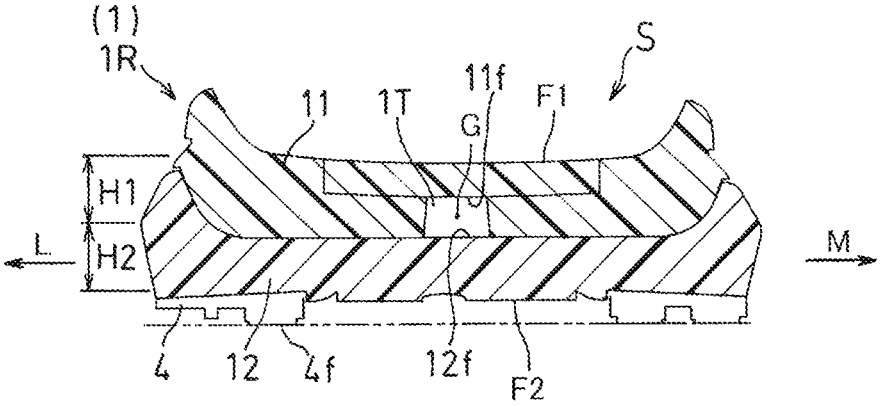
Figure 4C:
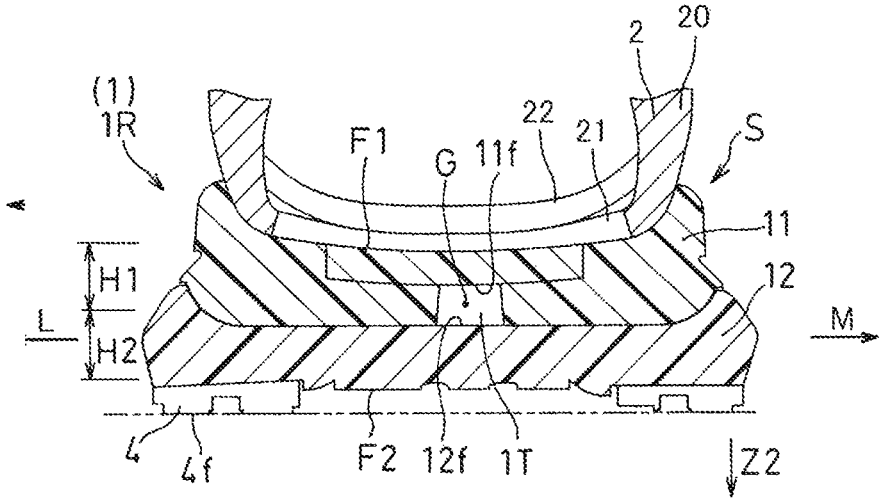

As shown in FIG. 4C, the midsole 1 is arranged over the outsole 4, contacting with the outsole 4. The midsole 1 and the outsole 4 are joined integrally with each other to form a shoe sole (shoe bottom) and are adhesively connected to an upper 2. More specifically, the midsole 1 is adhesively connected to an insole 21 and an outer surface of an instep member 20 forming parts of the upper 2. The instep member 20 surrounds the upper surface of the instep of a foot, and a side surface of a medial foot section and a side surface of a lateral foot section of the foot. The insole 21 is configured to be continuous with the instep member 20 and to be fitted with the sole of the foot.

The midsole 1 is arranged between the upper 2 including the insole 21 and the outsole 4. More specifically, the midsole 1 is arranged outside the upper 2 including the insole 21. A sock liner 22 is arranged on the insole 21 of the upper 2.

The midsole 1 in FIG. 2 defines a tunnel-shaped or groove-shaped hollow 1T, 1G extending in a front-rear direction of a shoe. In this embodiment, the tunnel-shaped or groove-shaped hollow is provided so as to extend across the rearfoot portion 1R, the middle foot portion 1M, and the forefoot portion 1F. The tunnel-shaped hollow 1T in the rearfoot portion 1R is open toward both a front direction and a rear direction.

As shown in FIGS. 4B and 4C, in the rearfoot portion 1R, the tunnel-shaped hollow forms a tunnel portion 1T where the midsole 1 surrounds a circumference of a cross section of the tunnel-shaped hollow.

Figure 3A:
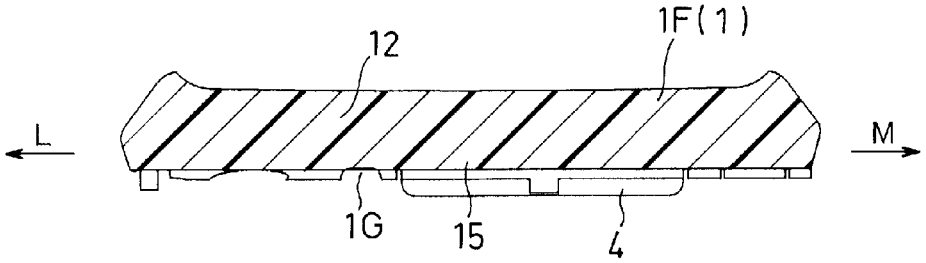
FIGS. 3A, 3B, 3C, and 3D are cross sectional views taken along a line IIIA-IIIA, a line IIIB-IIIB, a line IIIC-IIIC, and a line IIID-IIID in FIG. 1 respectively.
Figure 3B:
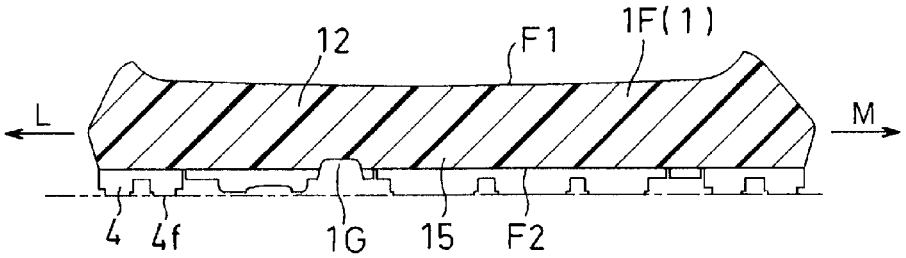
Figure 3C:
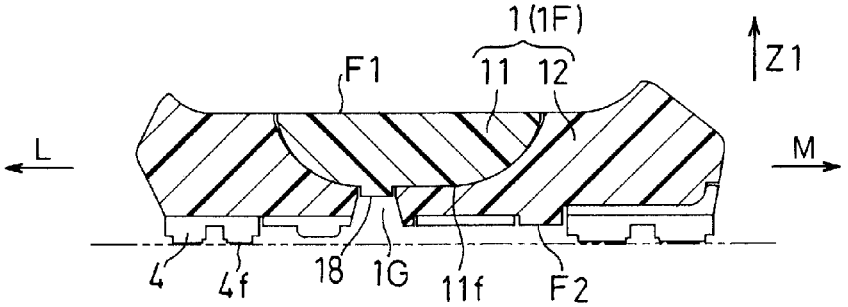
Figure 3D:
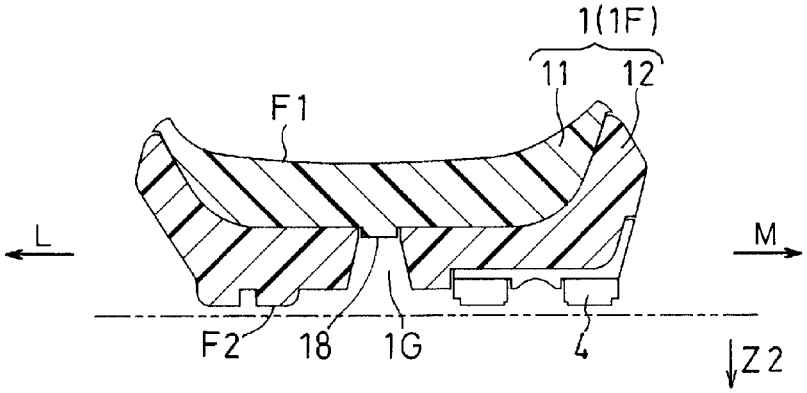

As shown in FIGS. 3A to 3C, in the forefoot portion 1F, the groove-shaped hollow forms a groove portion 1G where the groove-shaped hollow is open toward a downward direction Z2.

In FIG. 2, an anterior end of the tunnel portion 1T of the rearfoot portion 1R is continuous with a posterior end of the groove portion 1G of the forefoot portion 1F via the tunnel-shaped or groove-shaped hollow 1T, 1G of the middle foot portion 1M.

In this embodiment, the tunnel portion 1T is provided continuously entirely over the range from 0 to about 30% of the shoe sole. In a range from 30 to 40% of the entire length of the shoe sole from the posterior end Se of the shoe sole, the tunnel portion 1T and the groove portion 1G each have a downward inclination toward a front direction X1.

This downward inclination means that a top surface 18 of the tunnel portion 1T or the groove portion 1G is inclined toward the downward direction Z2 as the top surface extends in the front direction X1. In a range from 0 to about 10% corresponding to a posterior end portion of the shoe sole, the tunnel portion 1T may have a downward inclination toward the front direction X1.

As shown in FIGS. 3B to 3D and 4A, the foregoing inclination changes a distance from the top surface 18 to an upper surface F1 of the midsole 1. More specifically, this inclination changes the thickness of the midsole 1 corresponding to the tunnel portion 1T or the groove portion 1G.

Figure 5:
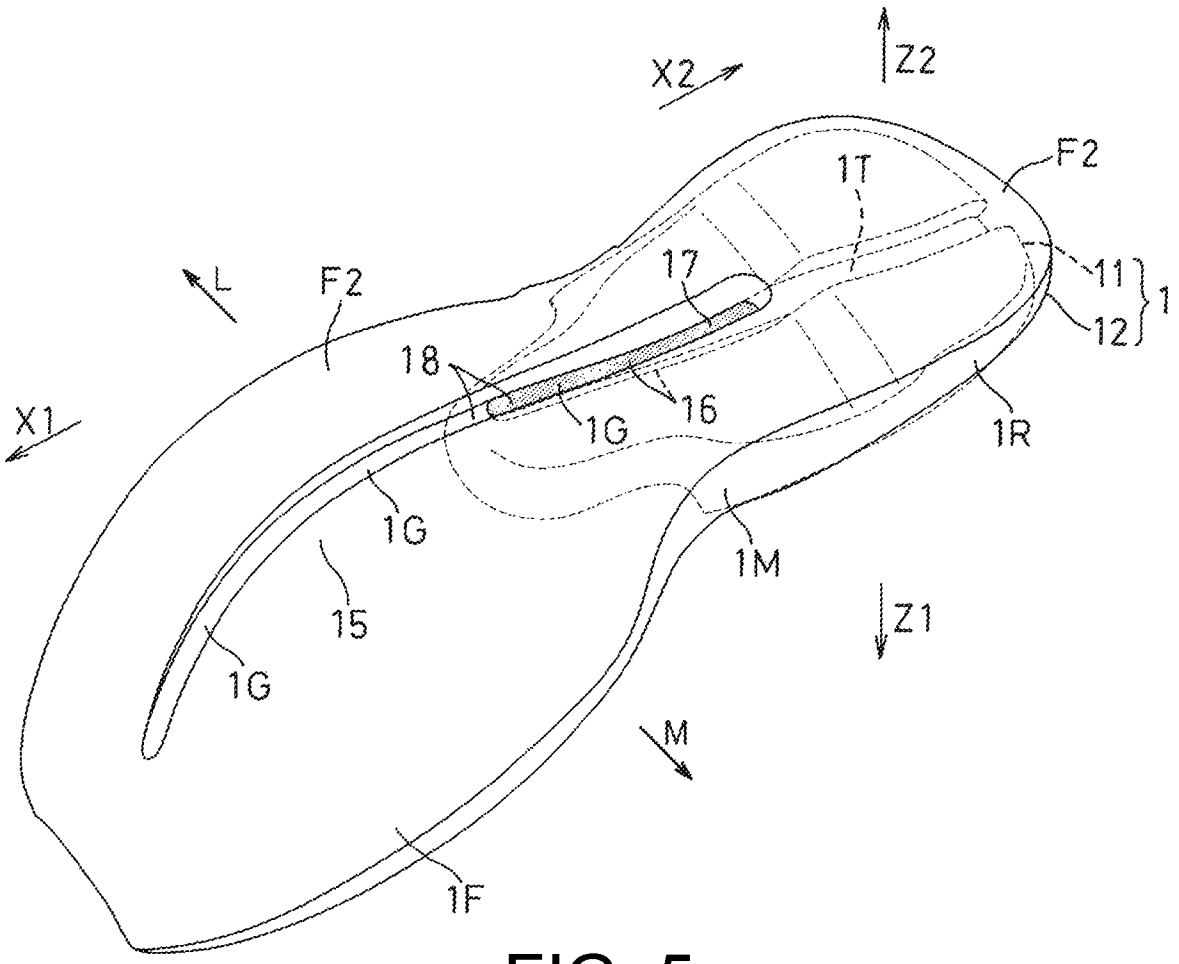
FIG. 5 is a perspective view of the midsole taken from diagonally below.
Figure 6:
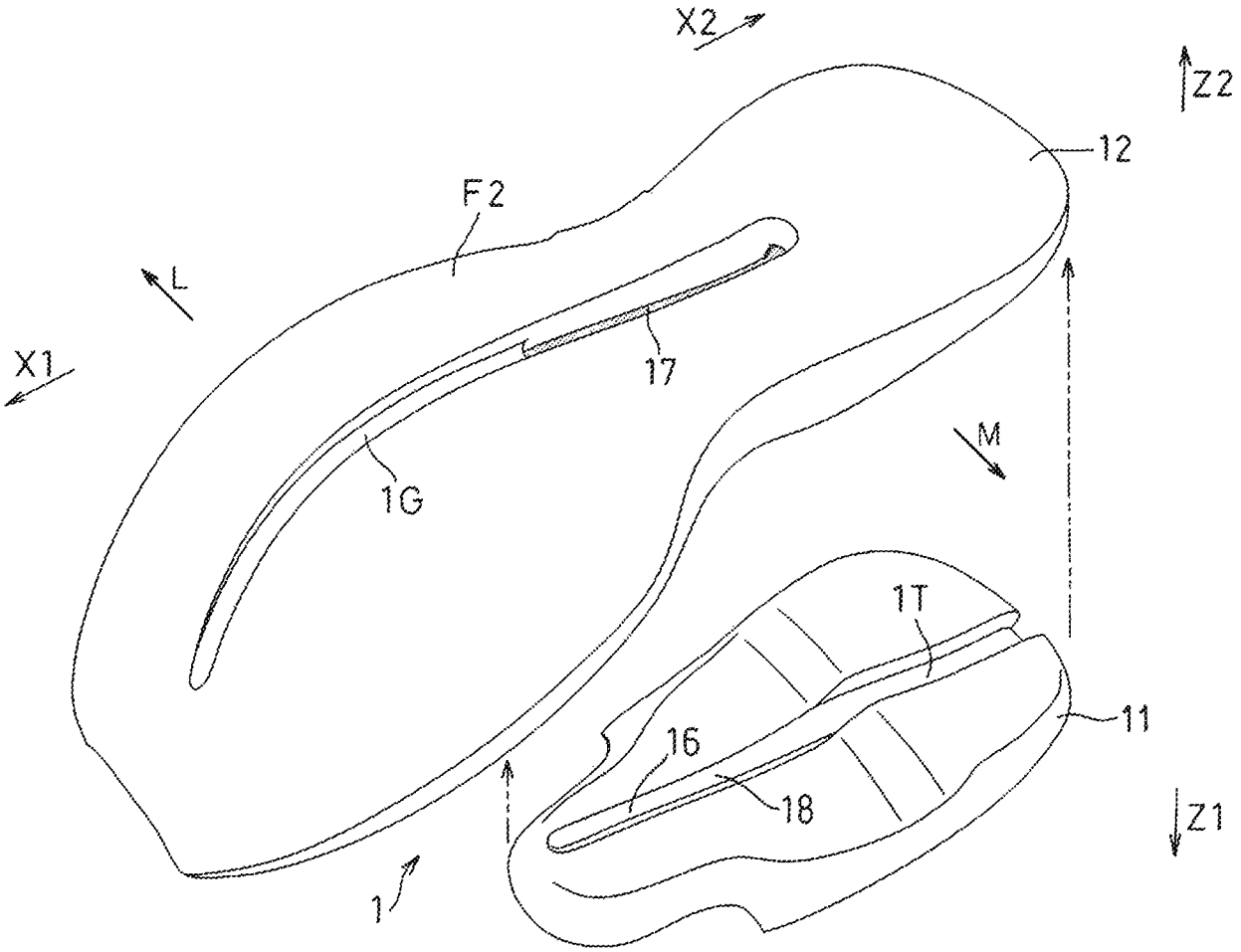
FIG. 6 is an exploded perspective view of the midsole.
Figure 7:
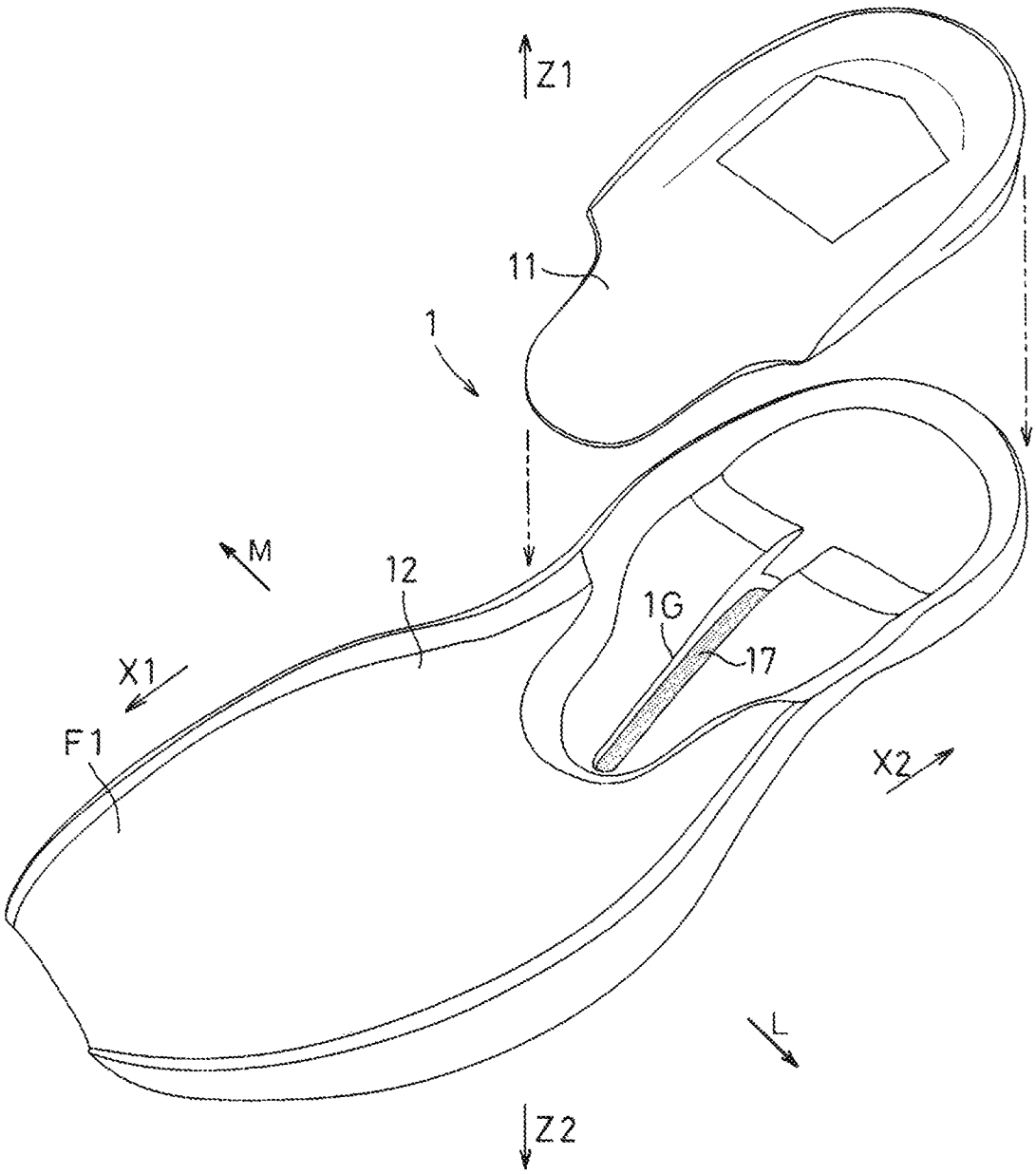
FIG. 7 is an exploded perspective view of the midsole taken from diagonally above.

As shown in FIGS. 5 to 7, in this embodiment, the midsole 1 in FIG. 5 includes an upper portion 11 and a lower portion 12 vertically joined to each other in the middle foot portion 1M and the rearfoot portion 1R. As shown in FIGS. 4B and 2, the upper portion 11 may be formed by joining two members to each other.

As shown in FIG. 2, the tunnel portion 1T is provided between a lower surface 11*f* of the upper portion 11 and an upper surface 12*f* of the lower portion 12. As shown in FIGS. 4B and 4C, along a cross section of the tunnel portion 1T, a circumference of the hollow is surrounded by the upper portion 11 and the lower portion 12 (midsole 1).

As shown by the dots in FIGS. 5 to 7, the lower portion 12 in FIG. 7 is given an elongated through hole 17 extending in the front-rear direction along the groove portion 1G. The upper portion 11 in FIG. 6 is given a projecting portion 16 forming a part of the top surface 18 of the groove portion 1G. The projecting portion 16 is a projecting strip extending long in the front-rear direction. By engaging the projecting portion 16 in the through hole 17, the positions of the upper portion 11 and the lower portion 12 are determined.

The tunnel portion 1T may be formed by machining or by using a 3D printer. Meanwhile, forming the tunnel portion 1T between the vertically divided upper portion 11 and lower portion 12 will improve productivity.

The tunnel portion 1T in FIG. 2 is open toward a rear direction X2 (or diagonally rearward) on the posterior end side, and is open toward the front direction X1 (or diagonally frontward) on the anterior end side to be continuous with the groove portion 1G in the front direction X1.

Along the cross section in FIG. 4B showing the rearfoot portion 1R of the midsole 1, a centroid G of the tunnel portion 1T is arranged closer to the upper surface F1 of the midsole 1 than a lower surface F2 of the midsole 1.

A center line 1C, formed by connecting the centroids G of the tunnel portion 1T in the front-rear direction in FIG. 2, is arranged in an upper half H1 of the rearfoot portion 1R in a region more than half (exceeding 50%) of the rearfoot portion 1R in the front-rear direction.

The two-dimensional arrangement of the tunnel portion 1T or that of the groove portion 1G will be described next.

As indicated by dashes in FIG. 1, in this embodiment, the tunnel portion 1T and the groove portion 1G are arranged at a central region 15 on a medial side M and a lateral side L of the midsole 1. The central region 15 mentioned herein as a region of arrangement of the tunnel portion 1T and the groove portion 1G may cover three central areas out of five areas defined by dividing the midsole 1 uniformly into five in a width direction.

The tunnel portion 1T or the groove portion 1G is preferably arranged mostly in the central region 15. In this description, mostly means a ratio of 80% or more. The tunnel portion 1T or the groove portion 1G may be arranged on the lateral side in the rearfoot portion 1R. In this case, shock absorbency will be improved.

In this embodiment, the tunnel portion 1T and the groove portion 1G are each gently curved into an S shape. Alternatively, each of the tunnel portion 1T and the groove portion 1G may be arranged in a linear pattern. Further, while the tunnel portion 1T is curved toward the lateral side L in the posterior end portion, it may alternatively be curved toward the medial side M.

The shape of a cross section of the tunnel portion 1T will be described next.

This shape may be a square, a circle, or an odd shape.

Figure 9:
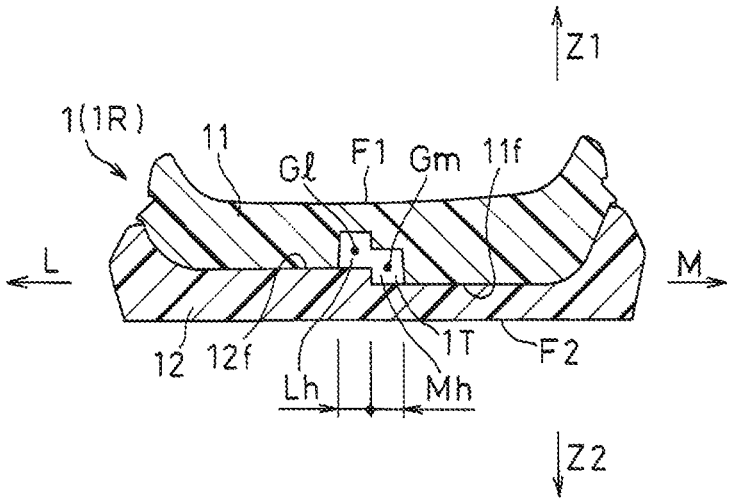
FIG. 9 is a cross sectional view of a rearfoot portion of the midsole showing a second embodiment.

FIG. 9 shows a second embodiment and shows an example where the tunnel portion 1T has an odd shape in a cross section.

In FIG. 9, the tunnel portion 1T includes a medial half Mh on a medial side and a lateral half LH on a lateral side at least along one cross section of the rearfoot portion 1R of the midsole 1, for example. A centroid Gm of the medial half Mh is arranged below a centroid Gl of the lateral half Lh.

Figure 10A:
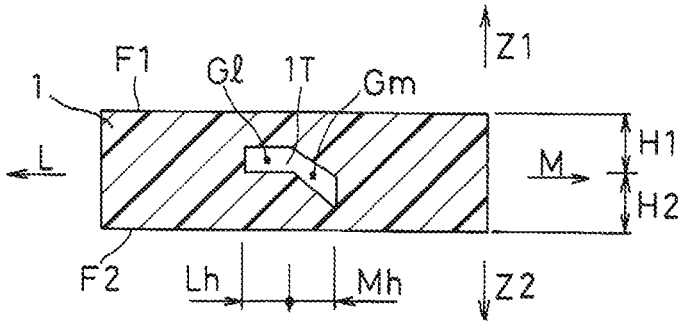
FIGS. 10A, 10B, and 10C are conceptual cross sectional views showing other embodiments of the midsole.
Figure 10B:
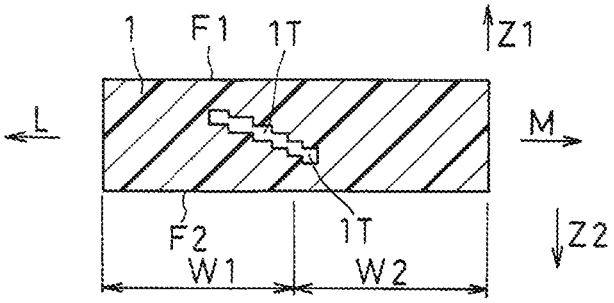
Figure 10C:
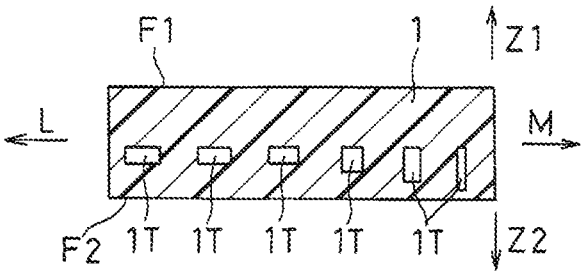

The foregoing cross section may have a diagonally downwardly inclined shape on the medial side M as shown in FIG. 10A, or may have a stepped shape as shown in FIG. 10B. As shown in FIG. 10C, the tunnel portion 1T may include multiple tunnel portions 1T separated toward the medial side and the lateral side.

As shown in FIG. 10B, in a region W1 and a region W2 defined by dividing the midsole 1 uniformly into two, into the medial side M and the lateral side L at least along one cross section of the rearfoot portion 1R of the midsole 1, the tunnel-shaped hollow 1T may have a larger area on the lateral side L than an area on the medial side M.

To show the effects of the foregoing first and second embodiments clearly, test results will be described next using test examples from Test 1 to Test 3 and comparative examples from Comp. 1 to Comp. 3 shown in FIGS. 12 to 15.

Figure 12:
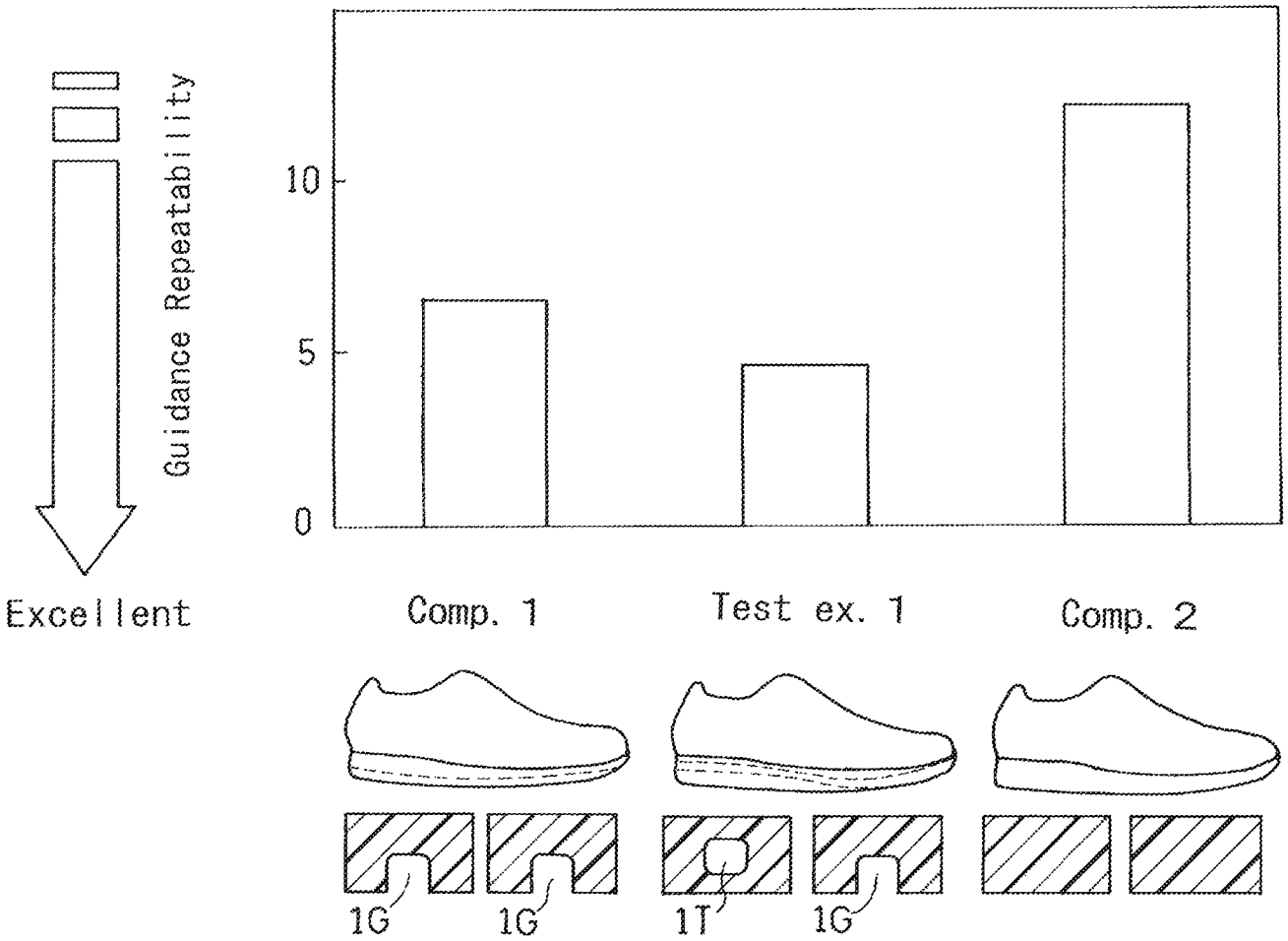
FIG. 12 is a graph showing a test result about reproducibility of a guidance.

FIG. 12 shows a test result about reproducibility during running.

Test ex. 1 includes the tunnel portion 1T and the groove portion 1G of the foregoing first embodiment. Comp. 1 as a comparative example includes only a groove. Comp. 2 as a comparative example does not include the groove portion 1G and the tunnel portion 1T.

As understood from FIG. 12, Test ex. 1 is significantly more excellent than Comp. 2 in terms of reproducibility during running, and is still better in terms of reproducibility during running than Comp. 1 including only the groove.

Possible reason for this is that a movement locus of the center of pressure CoP is guided along the tunnel portion 1T of the rearfoot portion and the groove portion 1G in the middle foot portion to approximate to a constant locus.

Figure 13:
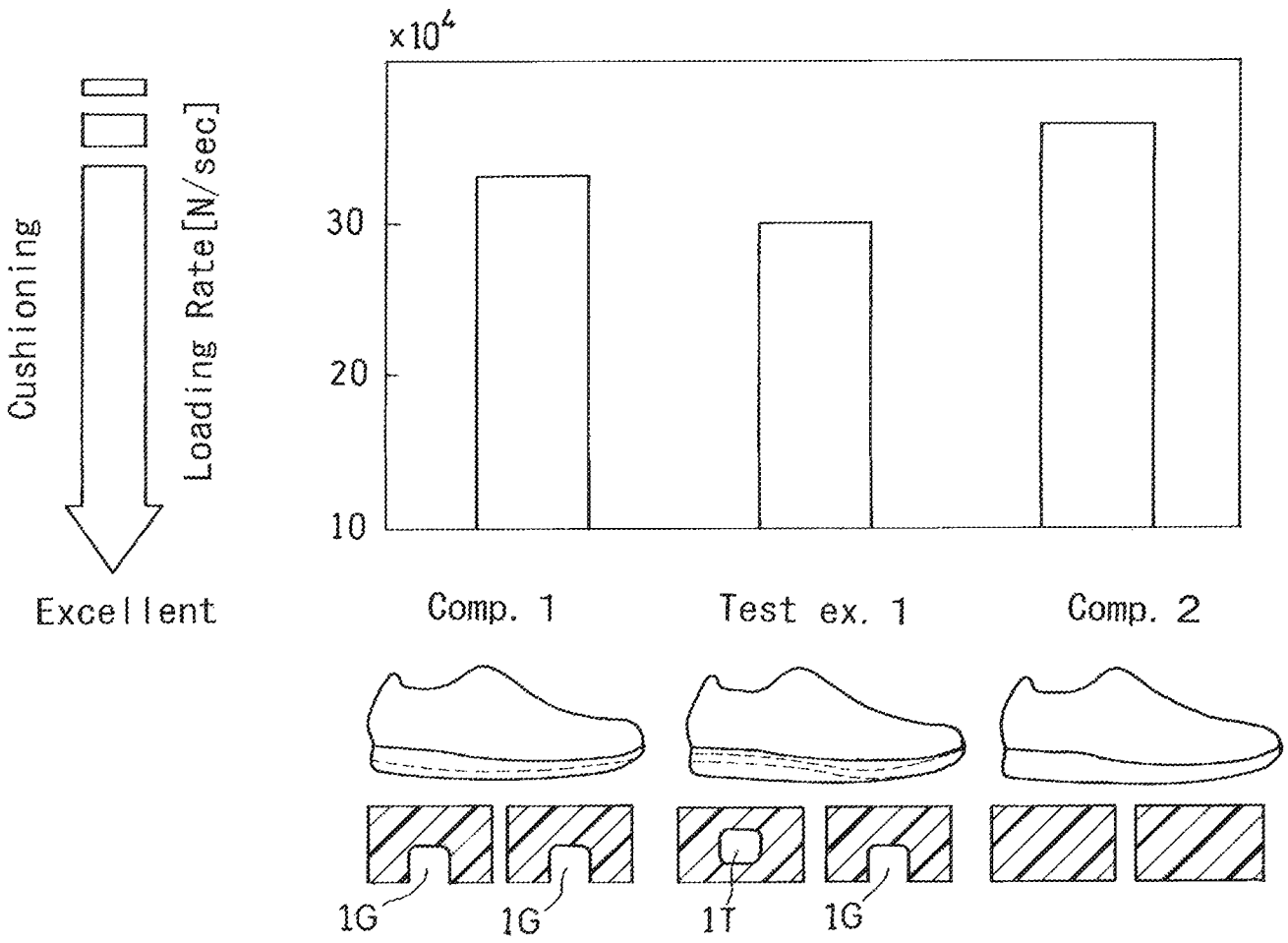
FIG. 13 is a graph showing a test result about shock absorbency.

FIG. 13 shows a test result about shock absorbency during running.

As understood from FIG. 13, Test ex. 1 results in lower load per unit time and is thus more excellent in terms of shock absorbency in the rearfoot portion during running than Comp. 2 and Comp. 1.

Possible reason for this is that the tunnel portion 1T is susceptible to deformation, as described above.

Figure 14:
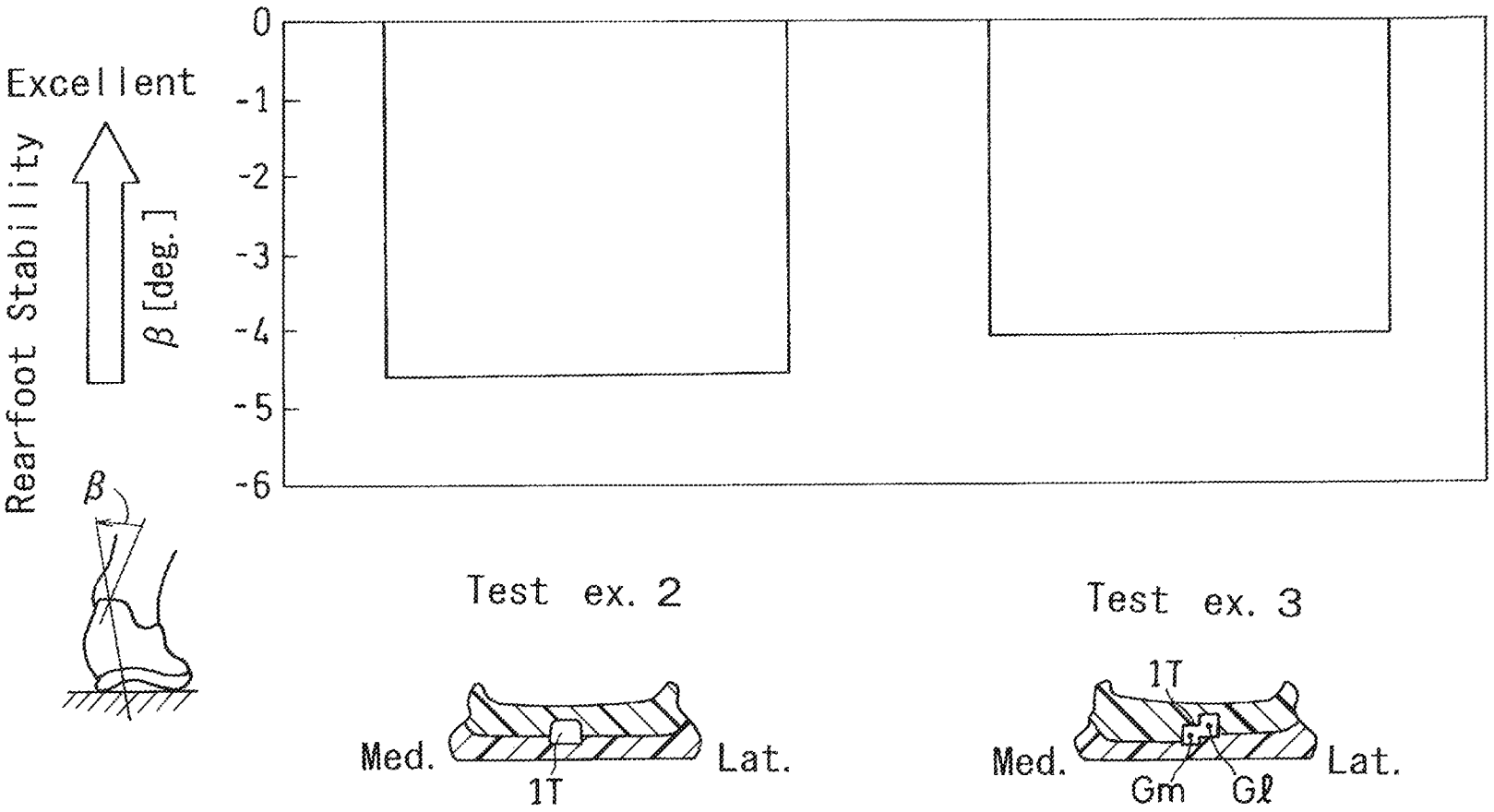
FIG. 14 is a graph showing a test result about stability performance in the rearfoot portion.

FIG. 14 shows a test result about stability performance in the rearfoot portion during running.

As an index for the stability performance, an eversion angle β at a heel section was measured immediately after contacting with the ground.

The tunnel portion 1T of Test ex. 2 has a trapezoidal cross section in FIG. 4B referred to above.

The tunnel portion 1T of Test ex. 3 has an odd-shaped cross section in FIG. 9 referred to above.

As understood from FIG. 14, Test ex. 3 with the tunnel portion 1T having the odd-shaped section results in the eversion angle β of a smaller absolute and is thus more excellent in terms of stability performance in the rearfoot portion than Test ex. 2 with the tunnel portion 1T having the trapezoidal section.

Possible reason for this is that, as the centroid Gm of the medial half is arranged below the centroid Gl of the lateral half in the tunnel portion 1T, pronation of inclining a foot toward the medial side of the midsole is suppressed.

This advantage will be achieved notably in a case where the tunnel portion 1T having the foregoing odd-shaped section is provided so as to extend, particularly from the rearfoot portion to the middle foot portion.

Figure 15:
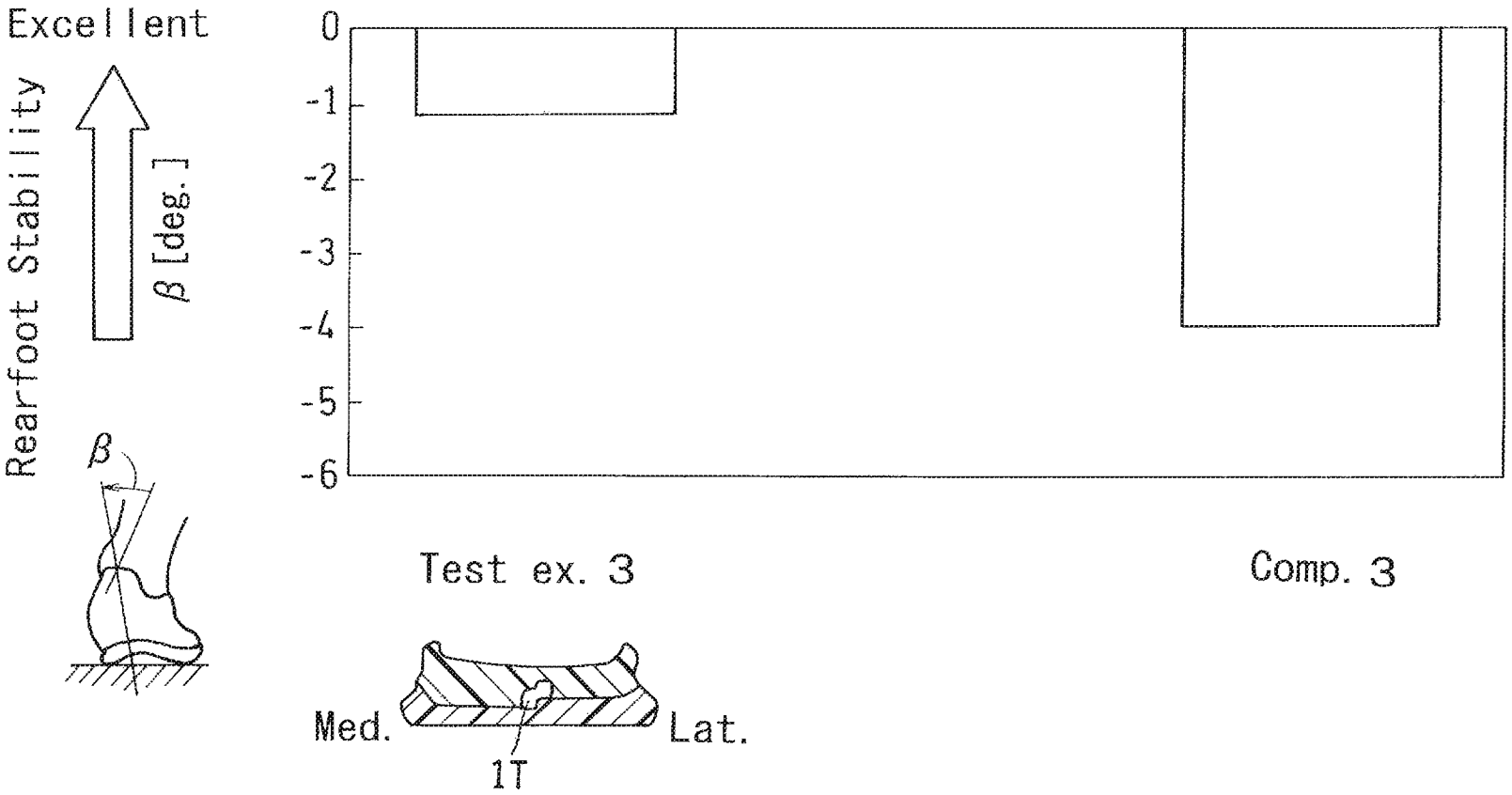
FIG. 15 is a graph showing a test result about stability performance in the rearfoot portion.

FIG. 15 shows a test result about stability performance in the rearfoot portion during running.

As understood from this figure, Test ex. 3 with the tunnel portion 1T having the foregoing odd-shaped section achieves significantly higher stability performance than Comp. 3 corresponding to a commercially available shoe without a hollow.

FIGS. 16A to 16D show a third embodiment.

As shown in these drawings, the tunnel portion 1T may be provided so as to extend continuously from the rearfoot portion 1R to the middle foot portion 1M. Further, the groove portion 1G continuous with the tunnel portion 1T in the middle foot portion 1M or the forefoot portion 1F may be provided so as to extend from the forefoot portion 1F to the middle foot portion 1M.

Figure 16A:
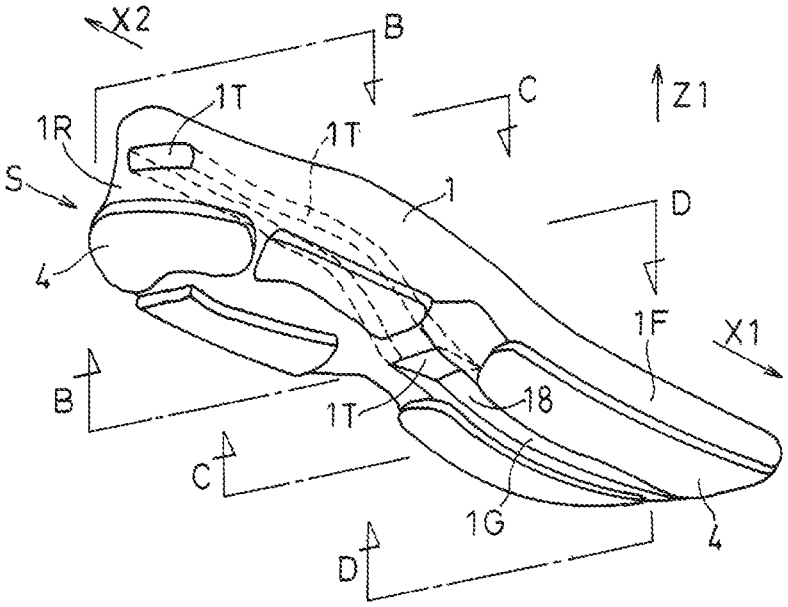
FIG. 16A is a perspective view of a shoe sole showing a third embodiment taken from diagonally below.
Figure 16B:
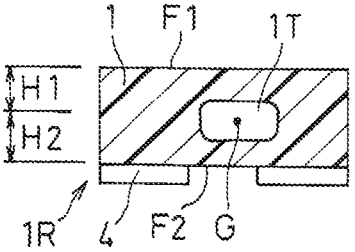
FIGS. 16B, 16C, and 16D are sectional views taken along a line B-B, a line C-C, and a line D-D in FIG. 16A respectively.

The centroid G of the tunnel portion 1T may be arranged in a region of either a lower half H2 or the upper half H1 along one section of the rearfoot portion 1R in FIG. 16B.

Figure 17:
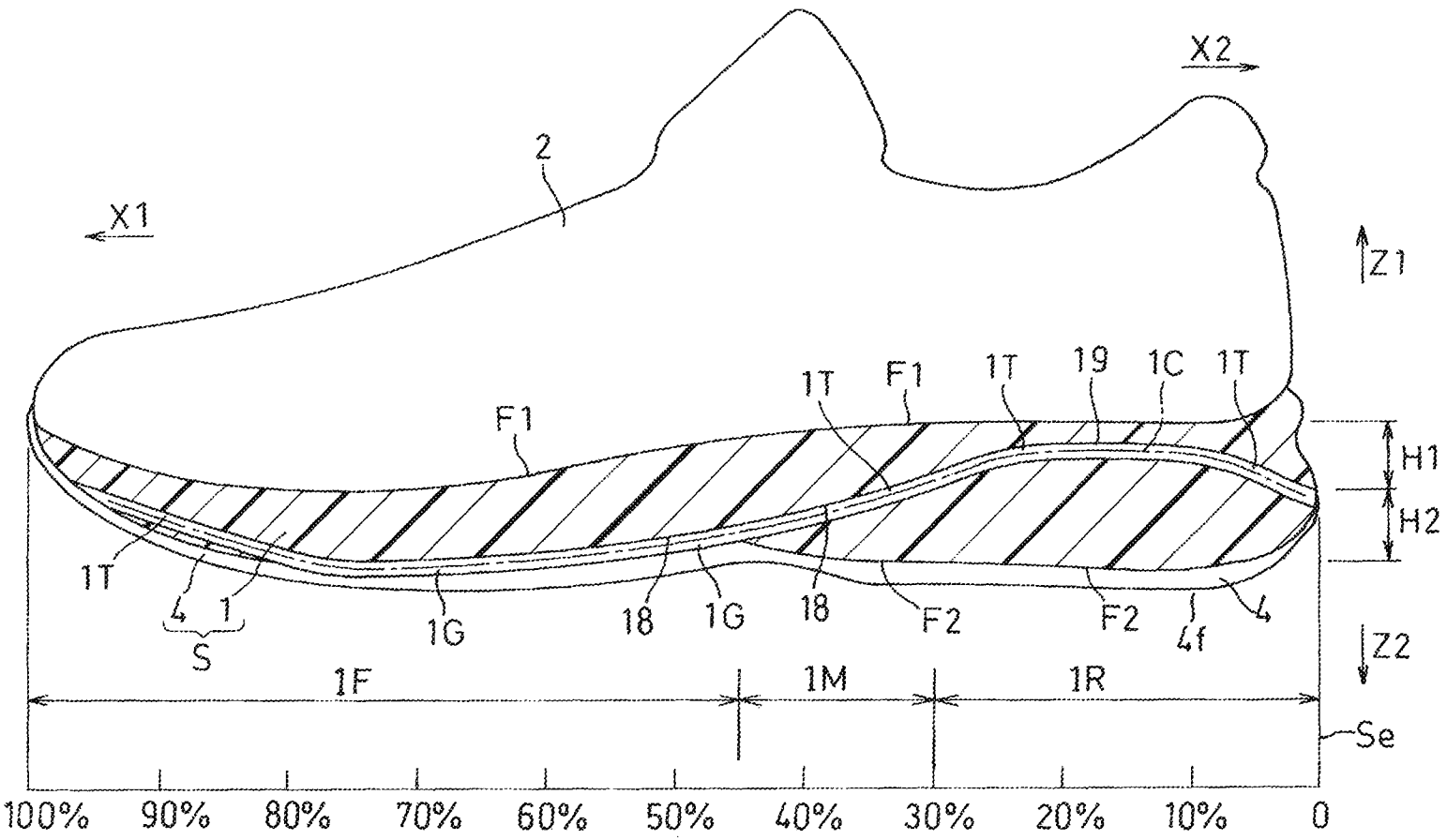
FIG. 17 shows a fourth embodiment and is a side view of a shoe with a shoe sole in a cut plane.
Figure 18:
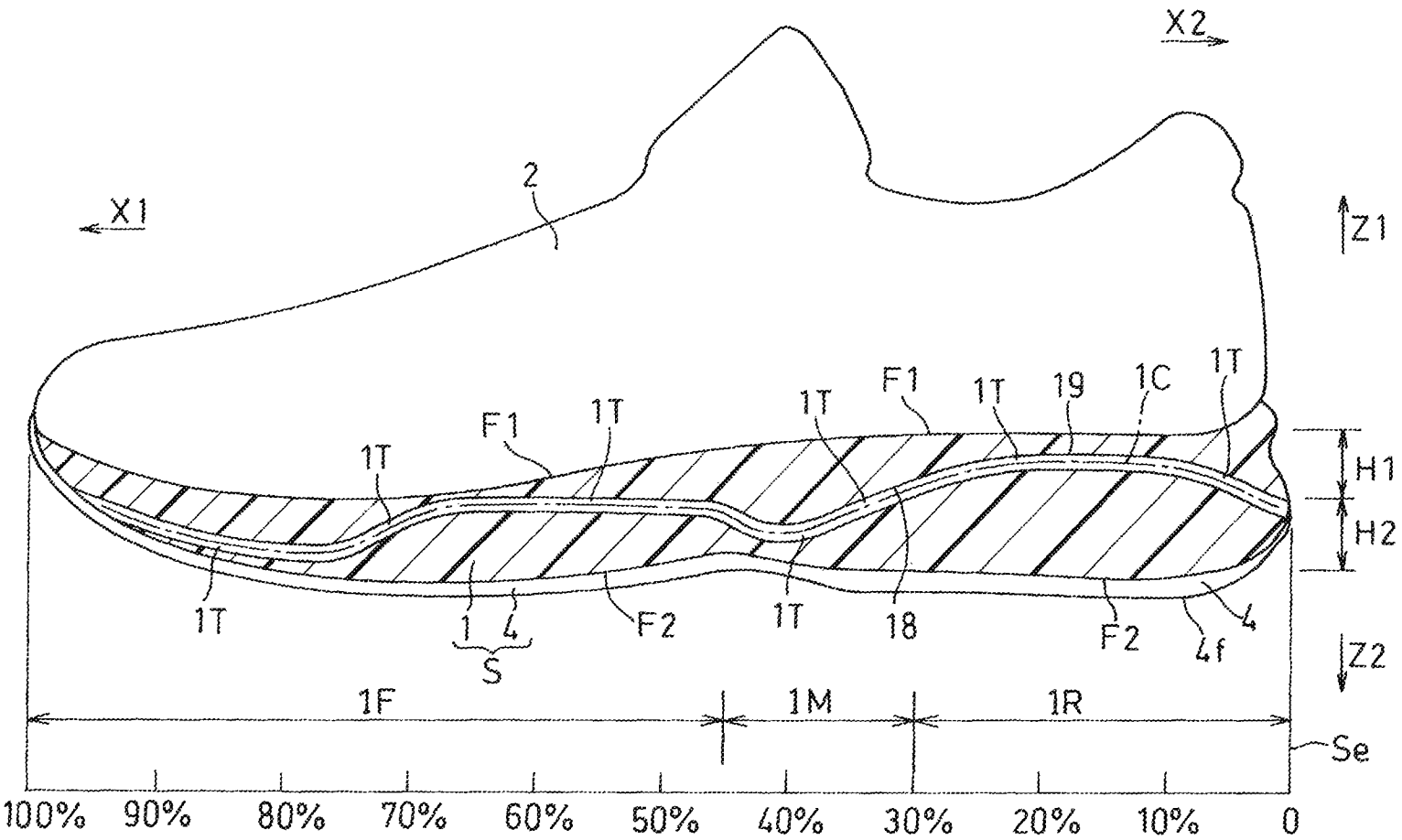
FIG. 18 shows a fifth embodiment and is a side view of a shoe with a shoe sole in a cut plane.

FIGS. 17 and 18 show a fourth embodiment and a fifth embodiment respectively.

In FIG. 17, the tunnel portion 1T or the groove portion 1G extends in the front direction X1 from the posterior end of the midsole 1. The tunnel portion 1T or the groove portion 1G extends 80% or more of the entire length of the shoe sole from the rearfoot portion 1R.

In a range from 0 to 10% of the entire length of the shoe sole from the posterior end of the shoe sole S, the tunnel portion 1T has an upward inclination toward the front direction.

In this range, the groove portion 1G may be provided instead of or in addition to the tunnel portion 1T.

In this embodiment, the center line 1C of the tunnel portion 1T extending in the front-rear direction is arranged in the upper half H1 of the rearfoot portion 1R, mostly (80% or more) of the region of the rearfoot portion 1R (in a range from 0 to 30%, for example) in the front-rear direction. In a region more than half of a longitudinal section of the rearfoot portion 1R, an uppermost end 19 of the tunnel portion 1T is arranged in the upper half H1 of the rearfoot portion 1R.

The upper half H1 of the rearfoot portion 1R means a region at a height of 50% from the upper surface F1 of the midsole 1. Whether being in the upper half H1 is to be determined along each cross section of the midsole 1.

In a range from 30 to 45% (middle foot portion 1M) of the entire length of the shoe sole from the posterior end Se of the shoe sole, the tunnel portion 1T has a downward inclination toward the front direction X1.

In this embodiment, as the hollow 1T, 1G reaches the forefoot portion 1F from the rearfoot portion 1R, this hollow follows a downward inclination toward the front direction X1.

Figure 16C:
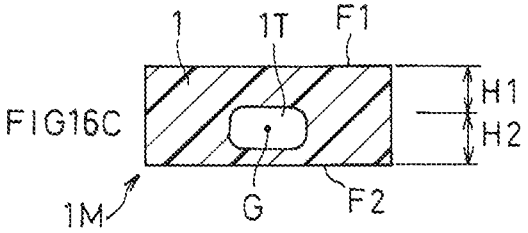
Figure 16D:
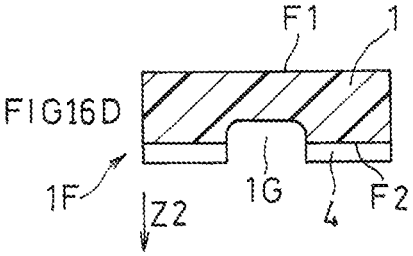

The tunnel portion 1T or the groove portion 1G is provided in a range from 40 to 50% of the entire length of the shoe sole. As shown in FIG. 16C, at least along one cross section of the midsole 1 in the range from 40 to 50%, the centroid G of the tunnel portion 1T is arranged at a position closer to the lower surface F2 of the midsole 1 than the upper surface F1 of the midsole 1.

In FIG. 17, the tunnel portion 1T or the groove portion 1G is provided in a range from 50 to 80% of the entire length of the shoe sole from the posterior end Se of the shoe sole. At least a part of the hollow in the range from 50 to 80% is arranged closer to the lower surface F2 of the midsole 1 than at least a part of the hollow in the range from 40 to 50%.

In FIG. 18, the tunnel portion 1T is further provided in the forefoot portion 1F. The tunnel portion 1T extends from the rearfoot portion 1R to the forefoot portion 1F.

In the embodiment shown in FIG. 18, at least a part of the tunnel portion 1T in the range from 50 to 80% is arranged closer to the upper surface F1 of the midsole 1 than at least a part of the tunnel portion 1T in the range from 40 to 50%.

A movement speed Vc of the center of pressure CoP will be described next.

Figure 11:
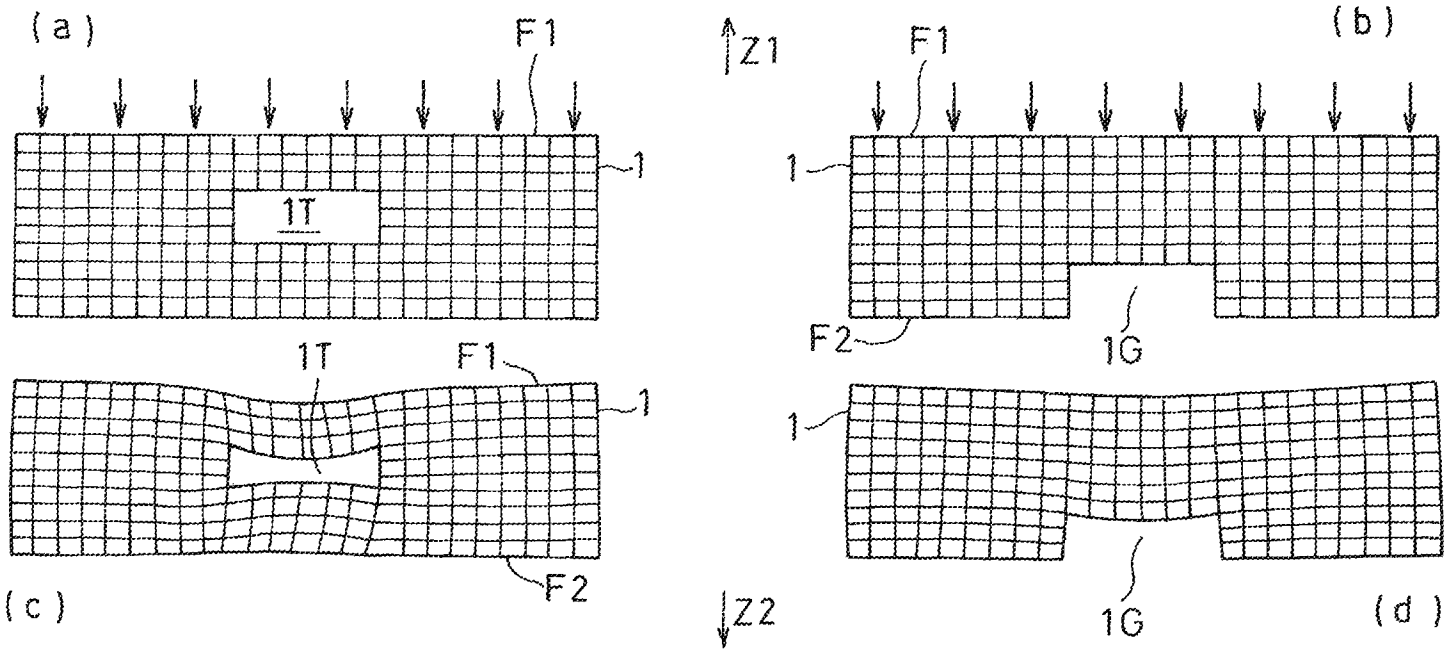
FIG. 11 is a conceptual view showing models used for calculation conducted using a computer.

As described above by referring to the tunnel portion 1T in FIG. 11(*c*) and the groove portion 1G in FIG. 11(*d*), deformation resulting from load becomes greater with a closer distance of the tunnel portion 1T to the upper surface F1 of the midsole 1. Likewise, deformation resulting from load becomes smaller with a closer distance of the tunnel portion 1T to the lower surface F2 of the midsole 1.

A relationship between a moment around a joint generated during running and the movement speed Vc of the center of pressure CoP will be described in detail next.

During running, a large moment is generated around the joint to cause load on a muscle.

The magnitude of the moment is determined by the outer product of a vector of ground reaction force (GRF) received from the ground and a distance to the joint (lever arm). A point of action of this force corresponds to the center of pressure CoP. Thus, controlling the position of the center of pressure CoP will allow control of the magnitude of the moment.

The foregoing moment generated during running reaches a peak at a point in time corresponding to about 15% and a point in time corresponding to about 40% of a support period at a knee joint, and reaches a peak at a time corresponding to an interval from about 40 to about 50% of a support period at an ankle joint.

Thus, controlling the movement speed of the center of pressure CoP is expected to achieve benefit, particularly in a range from 30 to 40% from the posterior end and a range from 50 to 100% from the posterior end corresponding to the foregoing points in time.

In the embodiments shown in FIGS. 2, 16A to 16D, 17, and 18, the height of the hollow 1T, 1G is changed for control of the speed of the center of pressure CoP. Further, forming the hollow into an inclined sloped shape will make the speed change smoothly.

If the hollow 1T, 1G ascends (has an upward inclination) toward the front direction X1, deformability increases toward the front direction X1. Thus, the center of pressure CoP is expected to move toward the front direction X1 at an increasing speed.

Meanwhile, if the hollow 1T, 1G descends (has a downward inclination) toward the front direction X1, deformability is reduced toward the front direction X1. Thus, the speed toward the front direction X1 is expected to decrease.

Figure 19A:
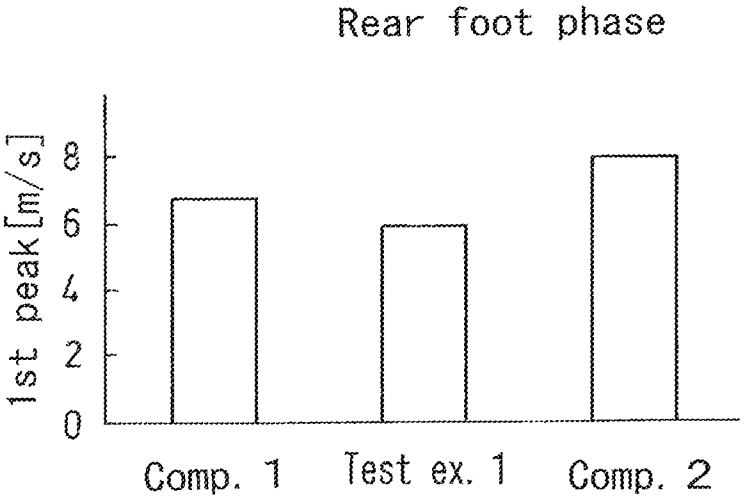
FIGS. 19A and 19B are graphs each showing a result of measurement about a peak of a movement speed of a center of pressure.
Figure 19B:
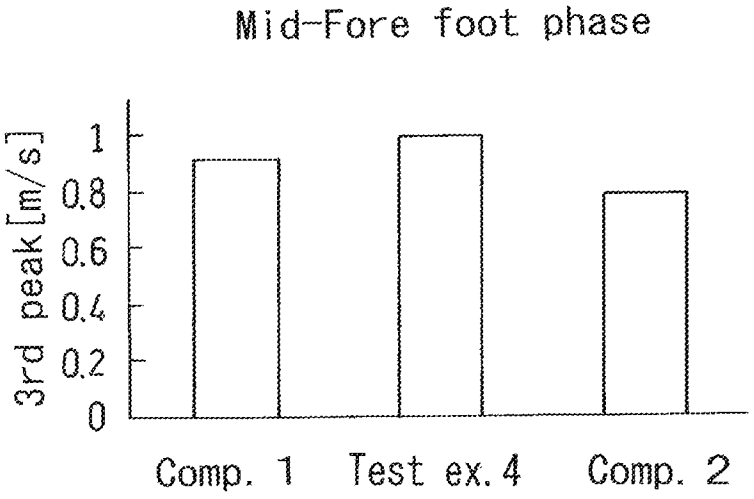
Figure 19C:
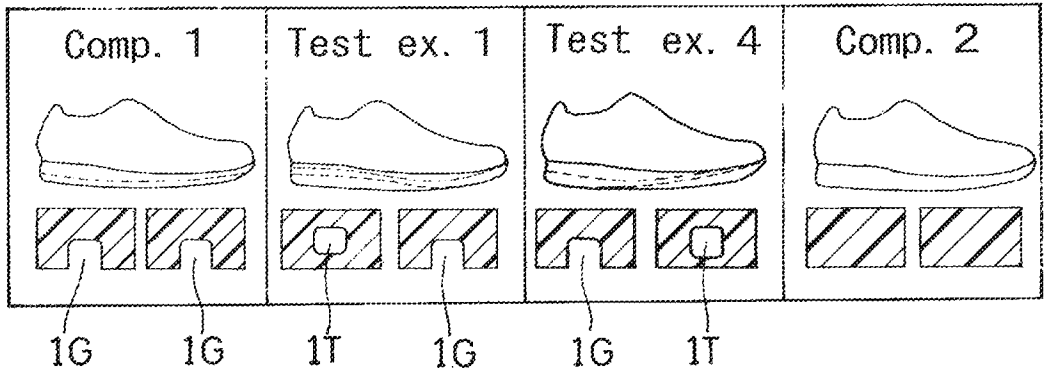
FIG. 19C is a conceptual view showing a shoe used for the measurement.

As actually shown in FIGS. 19A and 19C, Test ex. 1 with the descending tunnel portion 1T in the rearfoot portion is found to be capable of reducing the speed of a $1^{st}$ peak at a corresponding position. Meanwhile, a sample of Test ex. 4 with the ascending tunnel portion 1T from the middle foot portion to the forefoot portion is found to be capable of increasing the speed of a $3^{rd}$ peak at a corresponding position.

On the basis of the ideas described above, each portion according to the embodiments in FIGS. 17 and 18 will be described in terms of its function, etc.

Regarding the upward inclination of the tunnel portion 1T toward the front direction X1 in the range from 0 to 10% in each of FIGS. 17 and 18:

In the range from 0 to 10%, the ascending structure toward the front direction X1 is employed to encourage the center of pressure CoP to start moving toward the front direction X1 smoothly after landing.

Regarding arrangement of the tunnel portion 1T in the upper half H1 closer to the midsole upper surface F1 in the rearfoot portion 1R, particularly in a range from 10 to 20% at the posterior end:

In the rearfoot portion 1R, particularly in the range from 10 to 20% at the posterior end, large reaction force is applied from the ground so high shock absorbency is required. In response to this, the tunnel portion 1T is arranged in the upper half H1 of the midsole 1 to improve deformability.

Regarding the downward inclination of the tunnel portion 1T toward the front direction X1 in the range from 30 to 40%:

As described above, a moment around a knee joint reaches a peak in the range from 30 to 40%.

At this point in time, the position of the center of pressure CoP and that of the knee joint relative to each other are considered to be such that the center of pressure CoP is closer to the front direction X1. Thus, retaining the center of pressure CoP in the rear direction X2 as much as possible is considered to be important for reducing the movement speed Vc.

In this regard, in the range from 30 to 40% from the posterior end Se, the tunnel portion 1T is given the downward inclination to reduce the movement speed Vc of the center of pressure CoP.

Regarding arrangement of the hollow 1T, 1G close to the lower surface F2 of the midsole 1 in the range from 40 to 50% from the posterior end:

In the range from 30 to 40% from the posterior end, the hollow has the descending structure to locate the hollow 1T, 1G at a position close to the lower surface F2 of the midsole 1.

Regarding the range from 50 to 80% from the posterior end:

In this range, the position of the center of pressure CoP, that of a knee joint, and that of an ankle joint are considered to be such that the ankle joint, the center of pressure CoP, and the knee joint are located in this order as viewed from the rear direction. Thus, to reduce a distance between the knee joint and the center of pressure CoP, the center of pressure CoP is moved forward as much as possible to increase the movement speed Vc. Meanwhile, to reduce a distance between the ankle joint and the center of pressure CoP, the center of pressure CoP is retained in the rear direction as much as possible to reduce the movement speed Vc.

As understood from the foregoing, if reducing load on a position around the knee joint is intended, the tunnel portion 1T is arranged closer to the upper surface F1 of the midsole 1 in the range from 50 to 80% from the posterior end as shown in FIG. 18 to increase the movement speed Vc of the center of pressure CoP.

Meanwhile, if reducing load on a position around the ankle joint is intended, the groove portion 1G is arranged closer to the lower surface F2 of the midsole as shown in FIG. 17 to reduce the movement speed Vc of the center of pressure CoP.

Figure 20A:
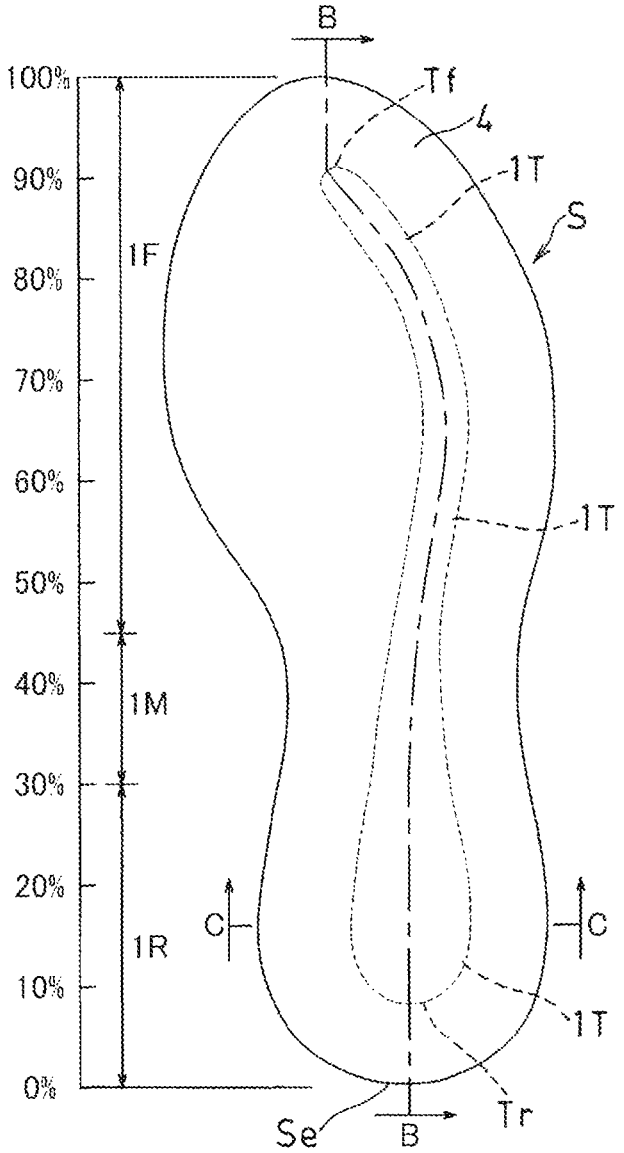
FIGS. 20A, 20B, and 20C are a bottom view, a B-B line sectional view, and a C-C line sectional view respectively showing a sixth embodiment.
Figure 20B:
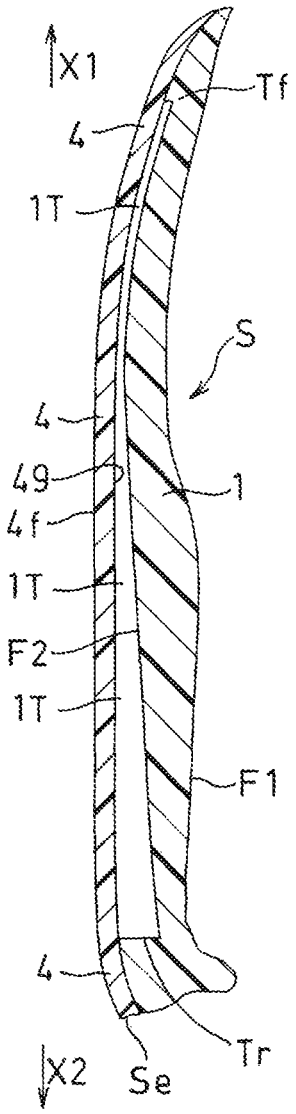
Figure 20C:
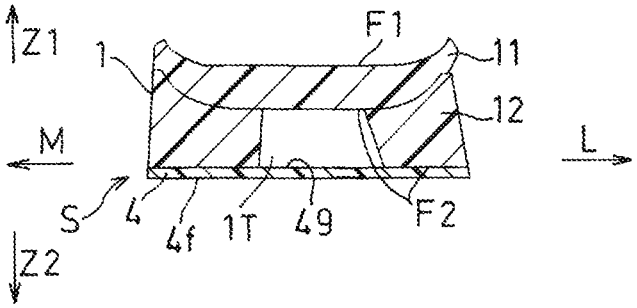

FIGS. 20A to 20C show a sixth embodiment.

In this embodiment, the outsole 4 is arranged directly under the midsole 1 while contacting the midsole 1.

The outsole 4 is made of a non-foamed body of polyurethane, for example. The midsole 1 is made of a softer material than the outsole 4.

The outsole 4 has a contact surface 4*f* and an upper surface 49 on the opposite side of the contact surface 4*f*. The upper surface 49 of the outsole 4 and the lower surface F2 of the midsole 1 are joined partially to each other.

The tunnel-shaped hollow 1T is formed at a remaining part of the lower surface F2 of the midsole 1 not joined to the outsole 4. The tunnel-shaped hollow 1T is covered by the outsole 4 and defined by the lower surface F2 of the midsole 1 and the upper surface 49 of the outsole 4. The hollow 1T of this embodiment may be enclosed by the midsole 1 and the outsole 4.

The tunnel-shaped hollow 1T extends in the front-rear direction from the rearfoot portion 1R to the forefoot portion 1F. For example, the hollow 1T may be arranged at least in a range from 20 to 70% from the posterior end Se of the shoe sole S.

A posterior end of the tunnel-shaped hollow 1T is closed by the midsole 1. This posterior end Tr of the hollow 1T may be arranged at a position in a range from 0 to about 20% from the posterior end Se of the shoe sole S, for example. To enclose the hollow 1T, the posterior end Tr may be arranged at a position in a range from about 5 to about 15% from the posterior end Se.

An anterior end Tf of the hollow 1T may be arranged at a position in a range from about 70 to 100% from the posterior end Se of the shoe sole S, for example. To enclose the hollow 1T, the anterior end Tf may be arranged at a position in a range from about 70 to about 98% from the posterior end Se.

Regarding enclosure of the hollow 1T, the hollow 1T may be enclosed to such an extent as to prevent entry of dust or dirt into the hollow 1T while permitting air to flow into the hollow 1T. More specifically, the hollow 1T is not required to be sealed. The hollow 1T may be filled with a gel-like solid or a soft material such as a jelly-like material (in a liquid form).

As indicated by dashes in FIG. 20A, the width of the hollow 1T may be larger in the rearfoot portion 1R than the widths of the hollow 1T in the forefoot portion 1F and the middle foot portion 1M. The outsole 4 may be semi-transparent or transparent and may have such transparency as to allow the shape of a plane (bottom surface) of the tunnel-shaped hollow 1T to be recognized visually.

Figure 21A:
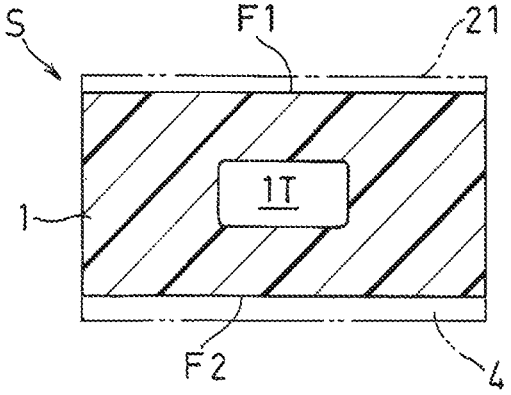
FIGS. 21A, 21B, and 21C are cross sectional views each showing an example of a tunnel-shaped hollow.
Figure 21B:
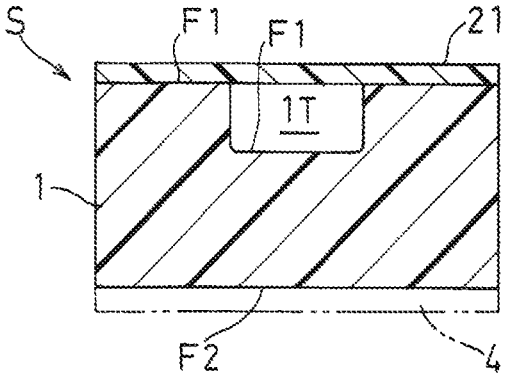
Figure 21C:
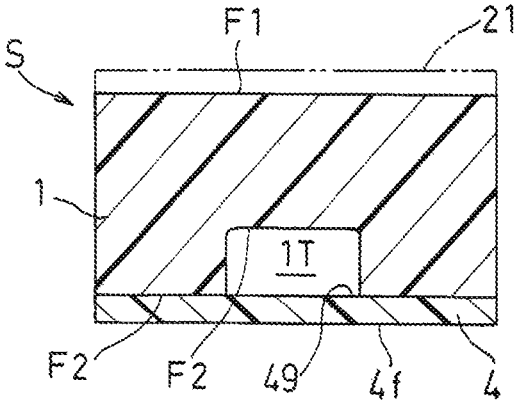

FIGS. 21A to 21C show embodiments of the tunnel-shaped hollow 1T. More specifically, the tunnel-shaped hollow 1T may be of one of the embodiments shown in FIGS. 21A, 21B, and 21C.

In the embodiment shown in FIG. 21A, the tunnel-shaped hollow forms the tunnel portion 1T. In this case, the insole 21 or the outsole 4 as separate members indicated by alternate long and two short dashed lines may be omitted from above or below the midsole 1.

In the embodiment shown in FIG. 21B, the tunnel-shaped hollow 1T is formed by providing a groove at the upper surface F1 of the midsole 1 and covering the groove with the insole 21. In this case, the outsole 4 as a separate member indicated by alternate long and two short dashed lines may be omitted from below the midsole 1.

In the embodiment shown in FIG. 21C, the tunnel-shaped hollow 1T is formed by providing a groove or recess at the lower surface F2 of the midsole 1 and covering the groove or recess with the outsole 4. In this case, the insole 21 as a separate member indicated by alternate long and two short dashed lines may be omitted from above the midsole 1.

Figure 22:
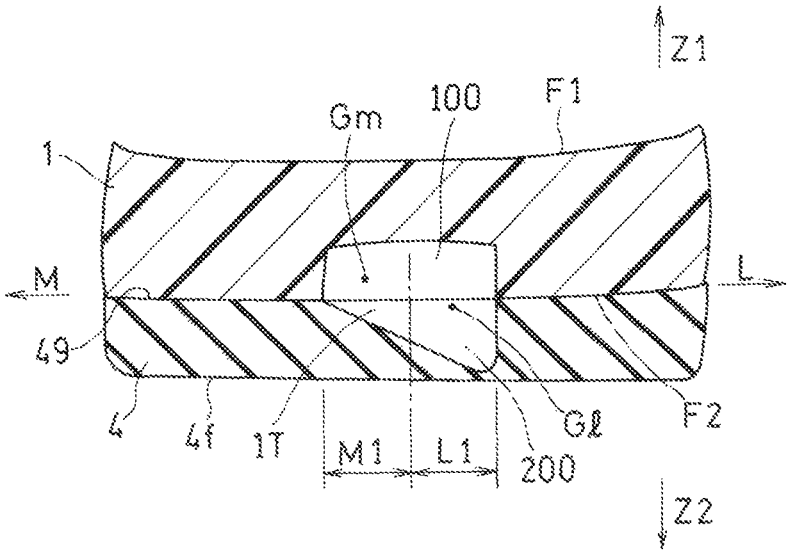
FIG. 22 is a cross sectional view showing a still different example of a tunnel-shaped hollow.

Regarding the tunnel-shaped hollow 1T shown in FIG. 22, a first groove 100 formed on (at) the lower surface F2 of the midsole 1 and a second groove 200 formed on (at) the upper surface 49 of the outsole 4 are connected with each other vertically to form the tunnel-shaped hollow 1T between the upper surface 49 of the outsole 4 and the lower surface F2 of the midsole 1.

If the width of the tunnel-shaped hollow 1T is bisected (divided) uniformly in a cross sectional direction L, M into two, into a medial side and a lateral side at least along one cross section of the hollow 1T, the second groove 200 of the outsole 4 has a larger area in a portion L1 on the lateral side than in a portion M1 on the medial side. By doing so, the portion L1 of the tunnel-shaped hollow 1T on the lateral side is offset downward, compared to the portion M1 on the medial side.

FIGS. 23 to 27 show a seventh embodiment.

Figure 25:
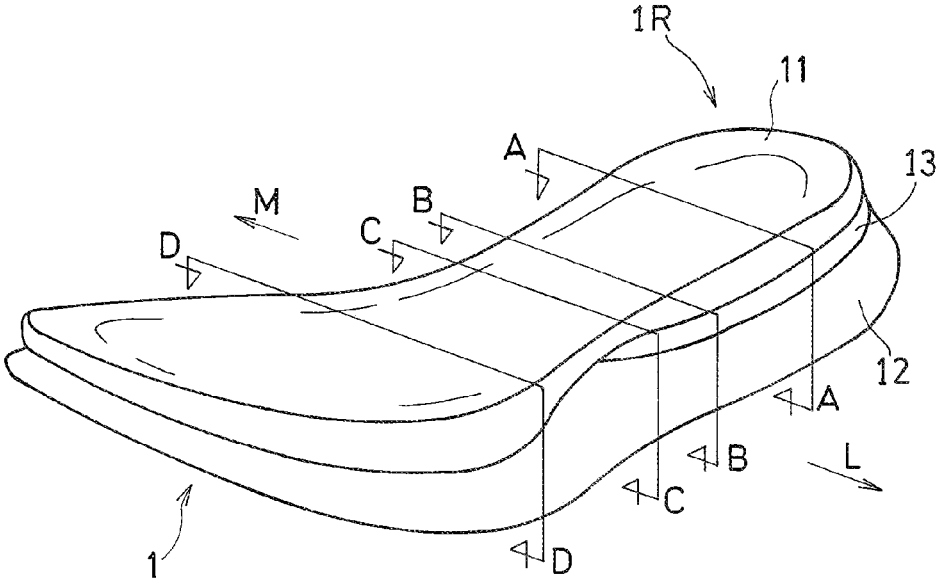
FIG. 25 is a perspective view showing a midsole of the seventh embodiment.

As shown in FIG. 25, in this embodiment, the midsole 1 includes the upper portion 11 and the lower portion 12 vertically joined to each other at least in the rearfoot portion 1R, and an intermediate layer 13 between the upper portion 11 and the lower portion 12.

Figure 24:
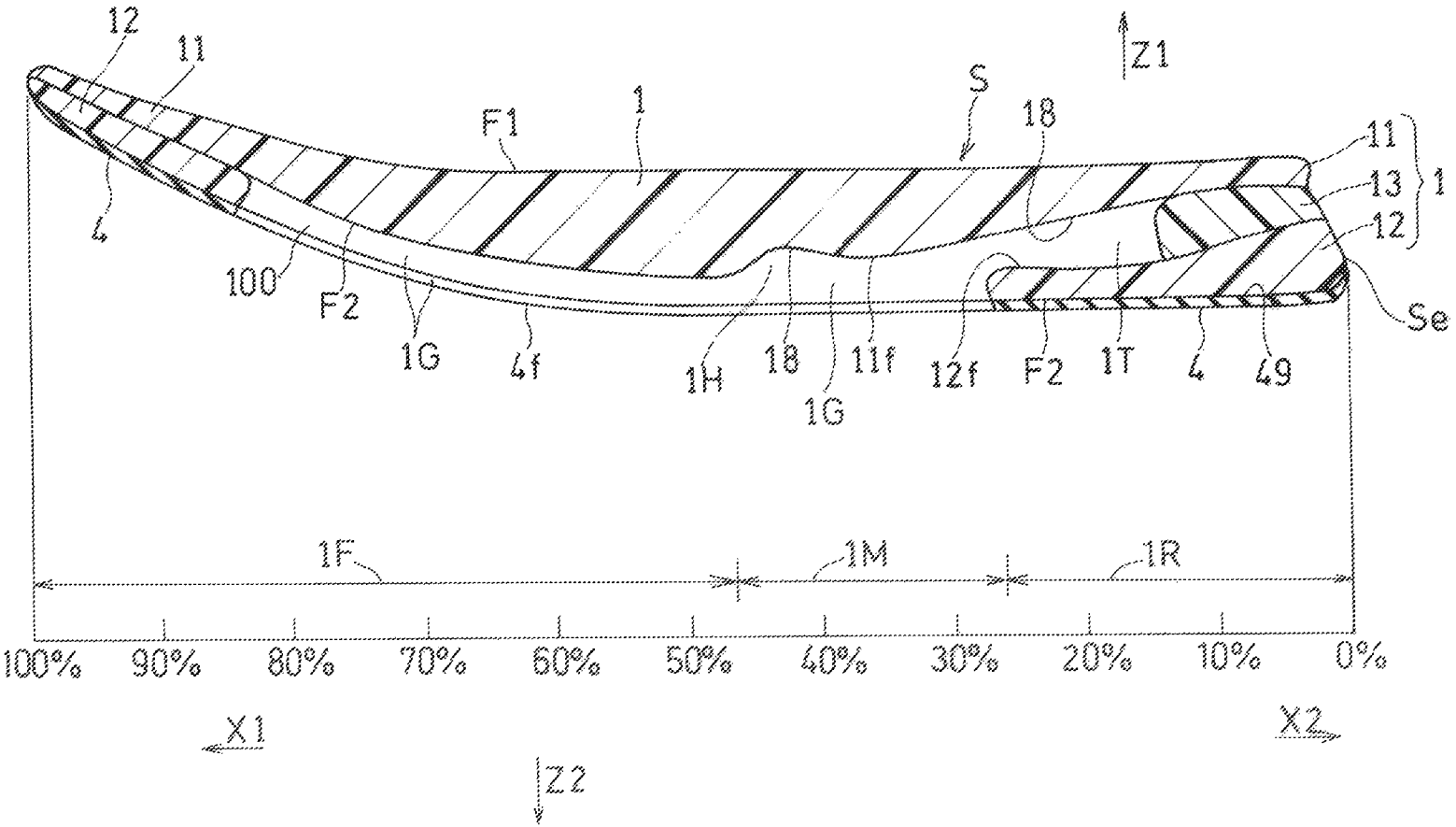
FIG. 24 is a longitudinal sectional view of FIG. 23.

As shown in FIG. 24, the tunnel-shaped hollow 1T is provided between the lower surface 11*f* of the upper portion 11 and the upper surface 12*f* of the lower portion 12 so as to extend in the front-rear direction. The tunnel-shaped hollow 1T has a posterior end closed by the intermediate layer 13, and an anterior end open toward the front direction.

The intermediate layer 13 may be made of a gel-like solid, for example. The intermediate layer 13 may be made of a material having higher resilience than a material forming the upper portion 11 and the lower portion 12. As indicated by dashes in FIG. 23, the intermediate layer 13 may be a shape like U in a plan view.

In FIG. 24, the tunnel-shaped or groove-shaped hollow is provided so as to extend across the rearfoot portion 1R, the middle foot portion 1M, and the forefoot portion 1F. At least in the rearfoot portion 1R, the tunnel-shaped hollow 1T forms a tunnel portion 1T where the midsole 1 surrounds a circumference of a cross section of the tunnel-shaped hollow.

In the forefoot portion 1F and the middle foot portion 1M, the groove-shaped hollow 1G is composed of the first groove 100 formed on (at) the lower surface F2 of the midsole 1. The anterior end of the tunnel portion 1T is continuous with the posterior end of the first groove 100 via the groove-shaped hollow 1G of the middle foot portion 1M.

In this embodiment, the tunnel-shaped hollow 1T provided in the rearfoot portion 1R is open toward the front direction and closed toward the rear direction.

Figure 26C:
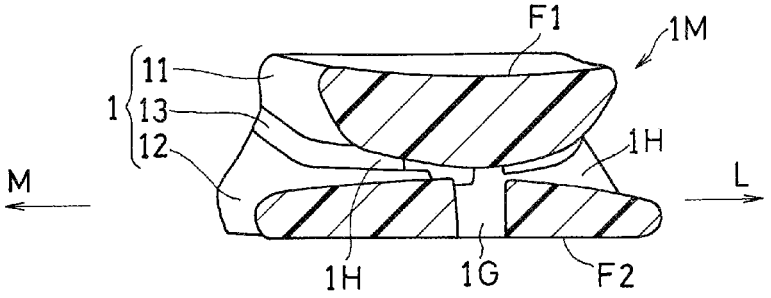
Figure 27:
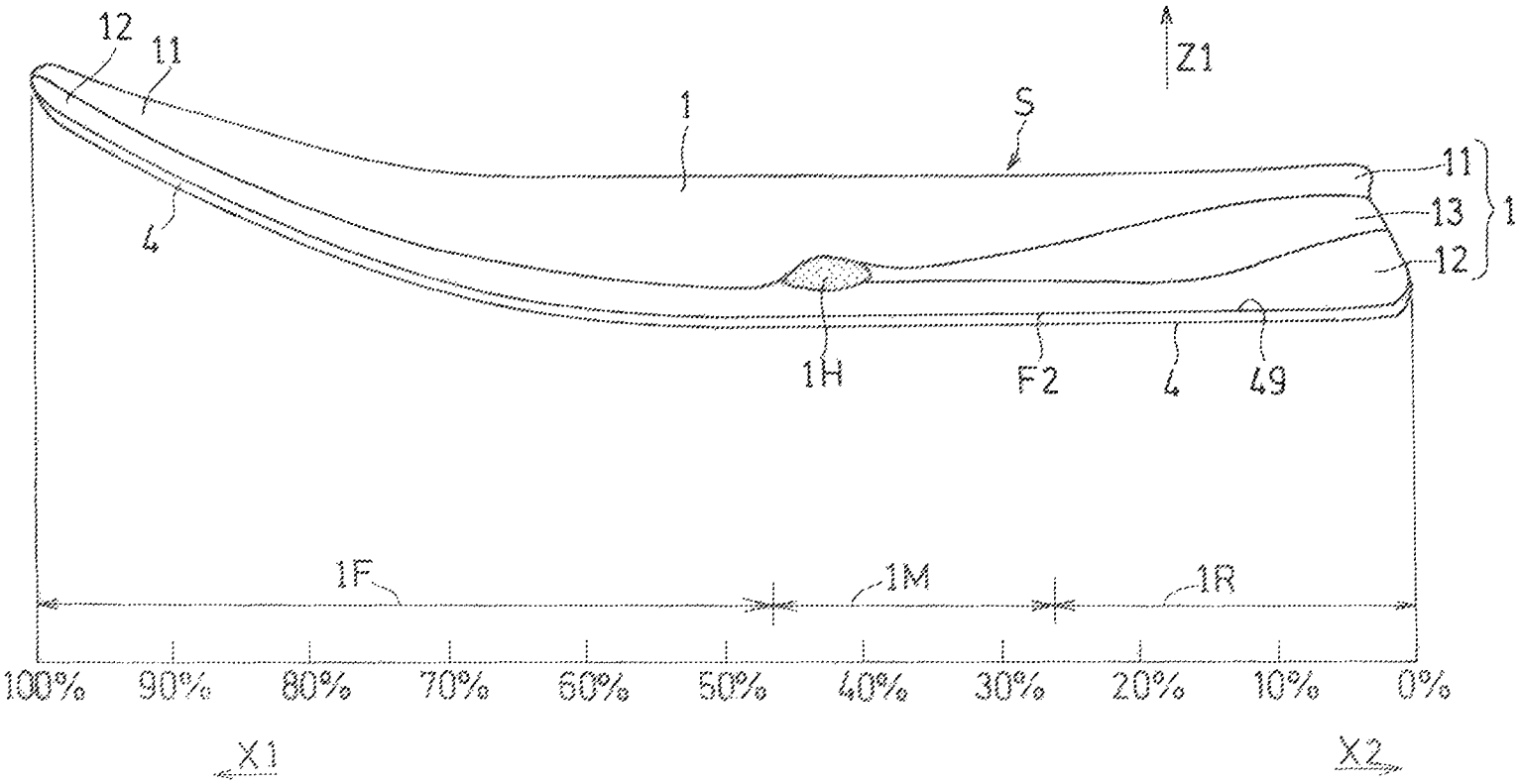
FIG. 27 is a side view showing the shoe sole of the seventh embodiment.

The tunnel-shaped hollow 1T in FIG. 24 is provided so as to extend from the posterior end of the middle foot portion 1M to the rearfoot portion 1R of the shoe sole. As shown in FIGS. 26C and 27, the middle foot portion 1M is provided with a tunnel-shaped through hole 1H extending in the cross sectional direction L, M and penetrating the middle foot portion 1M in the cross sectional direction L, M. At the anterior end of the rearfoot portion 1R in FIG. 24, the tunnel-shaped hollow 1T is open toward the tunnel-shaped through hole 1H.

Figure 26A:
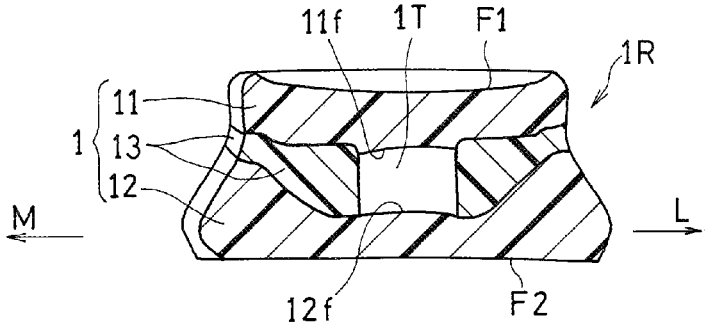
FIGS. 26A, 26B, 26C, and 26D are sectional views taken along a line A-A, a line B-B, a line C-C, and a line D-D in FIG. 25 respectively.
Figure 26B:
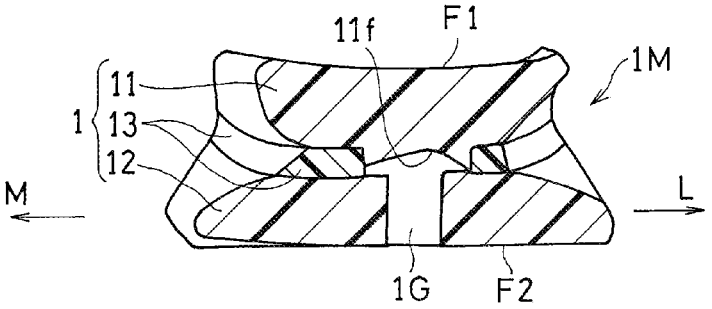
Figure 26D:
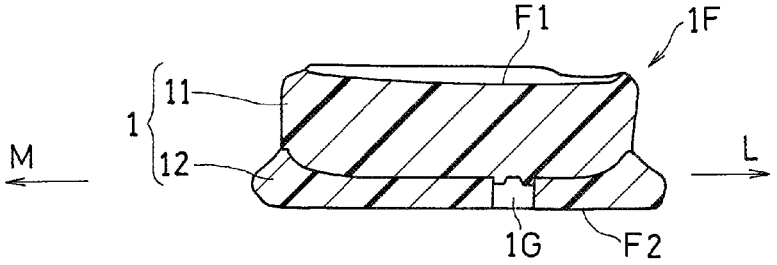

As shown in FIGS. 25 and 26A, the rearfoot portion 1R is provided with the tunnel-shaped hollow 1T. As shown in FIGS. 26B and 26C, the middle foot portion 1M is provided with the groove-shaped hollow 1G. As shown in FIG. 26D, the forefoot portion 1F is also provided with the groove-shaped hollow 1G.

The through hole 1H with dots in FIG. 27 in an anterior half of the middle foot portion 1M and the hollow 1G in FIG. 26C cross each other and communicate with each other.

The upper portion 11 and the lower portion 12 are separated from each other at a position corresponding to the through hole 1H, and the intermediate layer 13 is absent between the upper portion 11 and the lower portion 12 at this position.

In FIG. 24, the tunnel-shaped and groove-shaped hollows 1T, 1G have downward inclinations toward the front direction in a range from 20 to 40% of the entire length of the shoe sole from the posterior end Se of the shoe sole. In the range from 20 to 40%, the tunnel-shaped hollow 1T is arranged on the rear side (in the rear direction) and the groove-shaped hollow 1G is arranged on the front side (in the front direction), and the posterior end of the groove-shaped hollow 1G is continuous with the anterior end of the tunnel-shaped hollow 1T.

The groove-shaped hollow 1G in FIG. 24 is provided in a range from 30 to 40% of the entire length of the shoe sole from the posterior end Se of the shoe sole. In the range from 30 to 40%, the groove-shaped hollow has a downward inclination toward the front direction X1.

Figure 23:
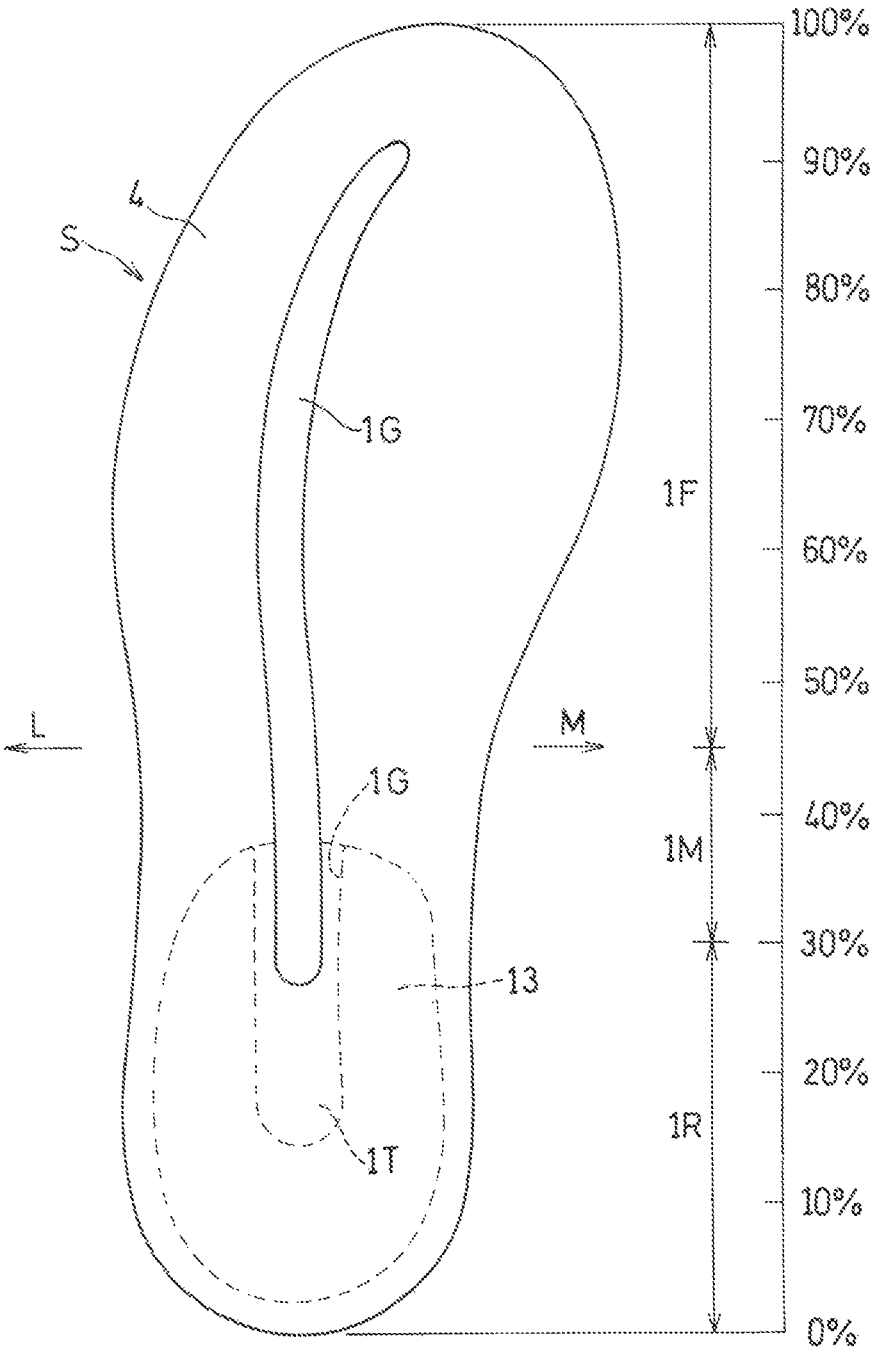
FIG. 23 is a bottom view of a shoe sole showing a seventh embodiment.

In FIGS. 23 and 24, the outsole 4 is provided so as to extend from the forefoot portion 1F to the rearfoot portion 1R. In this embodiment, the outsole 4 does not cover the groove-shaped hollow 1G. Alternatively, the outsole 4 may cover the hollow 1G along its entire length from below. The hollow 1G of this case is a tunnel-shaped hollow.

Figure 28:
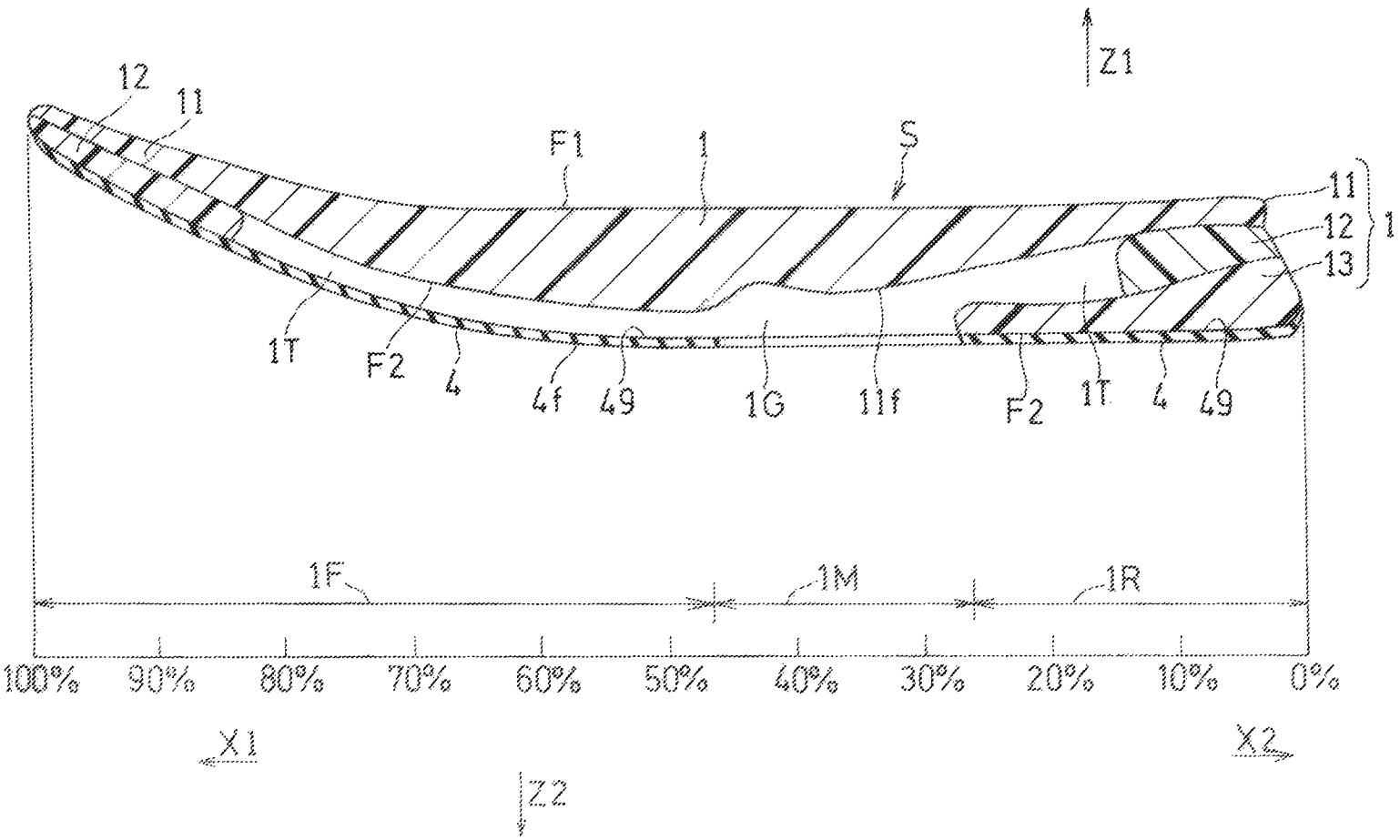
FIG. 28 is a longitudinal sectional view showing a shoe sole of an eighth embodiment.

FIG. 28 shows a modification of the seventh embodiment.

In this modification, the midsole 1 is arranged in the rearfoot portion 1R, the middle foot portion 1M, and the forefoot portion 1F. The outsole 4 is arranged in the rearfoot portion 1R and the forefoot portion 1F. The tunnel-shaped hollow 1T is provided in the rearfoot portion 1R and the forefoot portion 1F.

In the rearfoot portion 1R, the tunnel-shaped hollow 1T forms a tunnel portion 1T where the midsole 1 surrounds a circumference of a cross section of the tunnel-shaped hollow. In the forefoot portion 1F, the tunnel-shaped hollow 1T is formed between the lower surface F2 of the midsole 1 and the upper surface 49 of the outsole 4. The anterior end of the tunnel portion 1T of the rearfoot portion 1R is continuous with the posterior end of the tunnel-shaped hollow 1T of the forefoot portion 1F via the groove-shaped hollow 1G of the middle foot portion 1M.

While the preferred embodiments have been described above by referring to the drawings, a person with ordinary skill in the art who has read this description will easily think of various changes and modifications within an obvious range.

For example, the midsole 1 may partially contain gel. Alternatively, at least one of the outsole, the insole and the sock liner may be omitted.

For example, a transverse groove extending in a cross sectional direction may be provided.

Such changes and modifications are interpreted as being within the scope of the present invention defined by the claims.

INDUSTRIAL APPLICABILITY

The present invention is applicable to sports shoes worn in daily life, and for sports and games.

The invention claimed is:

1. A shoe sole, comprising:

an outsole having a contact surface; and a midsole arranged over the outsole, contacting with the outsole, wherein the midsole defines a tunnel-shaped or groove-shaped hollow extending in a front-rear direction of a shoe;

at least a part of the hollow is formed in a tunnel shape;

the tunnel-shaped hollow is provided in a rearfoot portion of the midsole so as to extend in the front-rear direction; and the tunnel-shaped hollow in the rearfoot portion is open toward a front direction and closed toward a rear direction.

2. The shoe sole according to claim 1, wherein:

the tunnel-shaped hollow is provided in a rearfoot portion of the shoe sole;

a middle foot portion of the shoe sole is provided with a tunnel-shaped through hole extending in a cross sectional direction and penetrating the middle foot portion in the cross sectional direction; and the tunnel-shaped hollow is open toward the tunnel-shaped through hole.

3. The shoe sole according to claim 1, wherein:

the midsole includes a rearfoot portion, a middle foot portion and a forefoot portion;

the tunnel-shaped or groove-shaped hollow is provided so as to extend across the rearfoot portion, the middle foot portion and the forefoot portion;

at least in the rearfoot portion, the tunnel-shaped hollow forms a tunnel portion where the midsole surrounds a circumference of a cross section of the tunnel-shaped hollow;

at least in the forefoot portion, the groove-shaped hollow forms a groove portion where the groove-shaped hollow is open toward a downward direction; and an anterior end of the tunnel portion is continuous with a posterior end of the groove portion via the tunnel-shaped or groove-shaped hollow of the middle foot portion.

4. The shoe sole according to claim 1, wherein:

the midsole is made of a softer material than the outsole;

the midsole includes a rearfoot portion, a middle foot portion, and a forefoot portion;

Reference Signs List

| | | | |
|---|---|---|---|
| 1: Midsole | F1: Upper surface | F2: Lower surface | |
| H1: Upper half | H2: Lower half | | |
| 1F: Forefoot portion | 1M: Middle foot portion | 1R: Rearfoot portion | |
| 11: Upper portion | 11f: Lower surface | 12: Lower portion | |
| 12f: Upper surface | 13: Intermediate layer | | |
| 1C: Center line | 1H: Through hole | | |
| 1G: Groove portion (groove-shaped hollow) | 1T: Tunnel portion (tunnel-shaped hollow) | | |
| 15: Central region | 16: Projecting portion | 17: Through hole | |
| 18: Top surface | 19: Upper end | 100: First groove | 200: Second groove |
| 2: Upper | 20: Instep member | 21: Insole | 22: Sock liner |
| Mh: Medial half of hollow | Lh: Lateral half of hollow | | |
| M1: Portion on medial side | L1: Portion on lateral side | | |
| 4: Outsole | 4f: Contact surface | 49: Upper surface | |
| G, Gm, Gl: Centroid | | | |
| S: Shoe sole | Se: Posterior end | | |
| Tf: Anterior end of hollow | Tr: Posterior end of hollow | | |
| X1: Front direction | X2: Rear direction | Z1: Upward direction | |
| Z2: Downward direction | | | |

the tunnel-shaped or groove-shaped hollow has a downward inclination toward a front direction in a range from 20 to 40% of an entire length of the shoe sole from a posterior end of the shoe sole; and in the range from 20 to 40%, the tunnel-shaped hollow is arranged on a rear side, the groove-shaped hollow is arranged on a front side, and a posterior end of the groove-shaped hollow is continuous with an anterior end of the tunnel-shaped hollow.

5. The shoe sole according to claim 4, wherein:

the tunnel-shaped or groove-shaped hollow is provided in a range from 30 to 40% of the entire length of the shoe sole from the posterior end of the shoe sole; and in the range from 30 to 40%, the tunnel-shaped or groove-shaped hollow has the downward inclination toward the front direction.

6. The shoe sole according to claim 1, wherein:

the midsole is made of a softer material than the outsole;

the midsole includes an upper portion and a lower portion vertically joined to each other at least in a rearfoot portion; and the tunnel-shaped hollow extending in the front-rear direction is provided between a lower surface of the upper portion and an upper surface of the lower portion, and the tunnel-shaped hollow has a closed posterior end and an open anterior end.

7. The shoe sole according to claim 1, wherein at least along one cross section of the tunnel-shaped hollow:

the tunnel-shaped hollow includes a medial half on a medial side and a lateral half on a lateral side; and a centroid of the medial half is arranged below a centroid of the lateral half.

8. The shoe sole according to claim 1, wherein:

the midsole includes a rearfoot portion and the tunnel-shaped hollow is provided in the rearfoot portion; and at least along one cross section of the rearfoot portion of the midsole, the tunnel-shaped hollow includes a medial half on a medial side and a lateral half on a lateral side; and a centroid of the medial half is arranged below a centroid of the lateral half.

9. The shoe sole according to claim 1, wherein:

a first groove formed on a lower surface of the midsole and a second groove formed on an upper surface of the outsole are vertically continuous with each other to form the tunnel-shaped hollow between the upper surface of the outsole and the lower surface of the midsole; and with the width of the tunnel-shaped hollow in a cross sectional direction bisected uniformly into a medial side and a lateral side at least along one cross section of the hollow, the second groove of the outsole has a larger area in a portion on the lateral side than in a portion on the medial side, thereby offsetting the portion on the lateral side of the tunnel-shaped hollow downward, compared to the portion on the medial side.

10. The shoe sole according to claim 9, wherein the midsole and the outsole include a rearfoot portion, and the tunnel-shaped hollow is provided in the rearfoot portion; and with the shoe sole divided uniformly into two, into the medial side and the lateral side at least along one cross section of the rearfoot portion, the tunnel-shaped hollow on the lateral side has a larger area than the tunnel-shaped hollow on the medial side.

11. The shoe sole according to claim 1, wherein:

the midsole is made of a softer material than the outsole;

the tunnel-shaped hollow is formed on a lower surface of the midsole, and the tunnel-shaped hollow is covered by the outsole and defined by the lower surface of the midsole and an upper surface of the outsole;

the tunnel-shaped hollow extends in the front-rear direction; and the tunnel-shaped hollow has a posterior end closed by the midsole.

12. A shoe sole, comprising:

an outsole having a contact surface; and a midsole arranged over the outsole, contacting with the outsole, wherein the midsole defines a tunnel-shaped or groove-shaped hollow extending in a front-rear direction of a shoe;

at least a part of the hollow is formed in a tunnel shape;

the midsole includes a rearfoot portion, a middle foot portion, and a forefoot portion;

the tunnel-shaped or groove-shaped hollow is provided so as to extend across the rearfoot portion, the middle foot portion, and the forefoot portion;

at least in the rearfoot portion, the tunnel-shaped hollow forms a tunnel portion where the midsole surrounds a circumference of a cross section of the tunnel-shaped hollow;

at least in the forefoot portion, the groove-shaped hollow is composed of a first groove formed on a lower surface of the midsole; and an anterior end of the tunnel portion is continuous with a posterior end of the first groove via the tunnel-shaped or groove-shaped hollow of the middle foot portion.

13. The shoe sole according to claim 12, wherein:

the midsole is made of a softer material than the outsole;

the tunnel-shaped or groove-shaped hollow has a downward inclination toward a front direction in a range from 20 to 40% of an entire length of the shoe sole from a posterior end of the shoe sole; and in the range from 20 to 40%, the tunnel-shaped hollow is arranged on a rear side, the groove-shaped hollow is arranged on a front side, and a posterior end of the groove-shaped hollow is continuous with an anterior end of the tunnel-shaped hollow.

14. The shoe sole according to claim 13, wherein:

the tunnel-shaped or groove-shaped hollow is provided in a range from 30 to 40% of the entire length of the shoe sole from the posterior end of the shoe sole; and in the range from 30 to 40%, the tunnel-shaped or groove-shaped hollow has the downward inclination toward the front direction.

15. The shoe sole according to claim 12, wherein:

the midsole is made of a softer material than the outsole;

the midsole includes an upper portion and a lower portion vertically joined to each other at least in a rearfoot portion; and the tunnel-shaped hollow extending in the front-rear direction is provided between a lower surface of the upper portion and an upper surface of the lower portion, and the tunnel-shaped hollow has a closed posterior end and an open anterior end.

16. The shoe sole according to claim 12, wherein:

the midsole is made of a softer material than the outsole;

the tunnel-shaped hollow is formed on a lower surface of the midsole, and the tunnel-shaped hollow is covered by the outsole and defined by the lower surface of the midsole and an upper surface of the outsole;

the tunnel-shaped hollow extends in the front-rear direction; and the tunnel-shaped hollow has a posterior end closed by the midsole.

17. The shoe sole according to claim 1, wherein: A shoe sole, comprising:

an outsole having a contact surface; and a midsole arranged over the outsole, contacting with the outsole, wherein the midsole defines a tunnel-shaped or groove-shaped hollow extending in a front-rear direction of a shoe;

at least a part of the hollow is formed in a tunnel shape;

the shoe sole includes a rearfoot portion, a middle foot portion, and a forefoot portion;

the midsole is arranged in the rearfoot portion, the middle foot portion, and the forefoot portion;

the outsole is arranged at least in the rearfoot portion and the forefoot portion;

the tunnel-shaped hollow is provided in the rearfoot portion and the forefoot portion;

at least in the rearfoot portion, the tunnel-shaped hollow forms a tunnel portion where the midsole surrounds a circumference of a cross section of the tunnel-shaped hollow;

at least in the forefoot portion, the tunnel-shaped hollow is formed between a lower surface of the midsole and an upper surface of the outsole; and an anterior end of the tunnel portion of the rearfoot portion is continuous with a posterior end of the tunnel-shaped hollow of the forefoot portion via the groove-shaped hollow of the middle foot portion.

18. The shoe sole according to claim 17, wherein:

the midsole is made of a softer material than the outsole;

the tunnel-shaped or groove-shaped hollow has a downward inclination toward a front direction in a range from 20 to 40% of an entire length of the shoe sole from a posterior end of the shoe sole; and in the range from 20 to 40%, the tunnel-shaped hollow is arranged on a rear side, the groove-shaped hollow is arranged on a front side, and a posterior end of the groove-shaped hollow is continuous with an anterior end of the tunnel-shaped hollow.

19. The shoe sole according to claim 18, wherein:

the tunnel-shaped or groove-shaped hollow is provided in a range from 30 to 40% of the entire length of the shoe sole from the posterior end of the shoe sole; and in the range from 30 to 40%, the tunnel-shaped or groove-shaped hollow has the downward inclination toward the front direction.

20. The shoe sole according to claim 17, wherein:

the midsole is made of a softer material than the outsole;

the midsole includes an upper portion and a lower portion vertically joined to each other at least in a rearfoot portion; and the tunnel-shaped hollow extending in the front-rear direction is provided between a lower surface of the upper portion and an upper surface of the lower portion, and the tunnel-shaped hollow has a closed posterior end and an open anterior end.

21. The shoe sole according to claim 17, wherein:

the midsole is made of a softer material than the outsole;

the tunnel-shaped hollow is formed on a lower surface of the midsole, and the tunnel-shaped hollow is covered by the outsole and defined by the lower surface of the midsole and an upper surface of the outsole;

the tunnel-shaped hollow extends in the front-rear direction; and the tunnel-shaped hollow has a posterior end closed by the midsole.

* * * * *